US011148443B2

(12) United States Patent
Tamai et al.

(10) Patent No.: US 11,148,443 B2
(45) Date of Patent: Oct. 19, 2021

(54) CLEANING DEVICE AND IMAGE FORMING APPARATUS

(71) Applicant: KYOCERA Document Solutions Inc., Osaka (JP)

(72) Inventors: Hiroatsu Tamai, Osaka (JP); Naoto Miyakoshi, Osaka (JP); Shunsuke Yamasaki, Osaka (JP); Shinobu Ohata, Osaka (JP); Yasuhiro Michishita, Osaka (JP); Takeshi Watanabe, Osaka (JP); Kenichi Satake, Osaka (JP); Hiroki Sakane, Osaka (JP); Masato Usui, Osaka (JP); Yuzuru Yuasa, Osaka (JP); Yusuke Tamekuni, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/885,347

(22) Filed: May 28, 2020

(65) Prior Publication Data

US 2020/0376866 A1 Dec. 3, 2020

(30) Foreign Application Priority Data

May 30, 2019 (JP) ..... JP2019-101715
Sep. 26, 2019 (JP) ..... JP2019-175353

(51) Int. Cl.
*B41J 29/17* (2006.01)
*B41F 35/00* (2006.01)
(Continued)

(52) U.S. Cl.
CPC ..... *B41J 29/17* (2013.01); *B41F 35/00* (2013.01); *B41P 2235/24* (2013.01);
(Continued)

(58) Field of Classification Search
None
See application file for complete search history.

(56) References Cited

U.S. PATENT DOCUMENTS 4,538,156 A * 8/1985 Durkee ..... B41J 2/005 346/104
5,559,591 A * 9/1996 Kato ..... G03G 15/2025 15/256.51
(Continued)

FOREIGN PATENT DOCUMENTS

JP 2004-345805 12/2004
JP 2005169968 A * 6/2005
(Continued)

*Primary Examiner* — Jill E Culler
(74) *Attorney, Agent, or Firm* — Gerald E. Hespos; Michael J. Porco; Matthew T. Hespos

(57) ABSTRACT

A cleaning device includes a controller configured to control cleaning of a conveyance roller by a web. The controller includes a take-up control unit and a web end determination unit. The take-up control unit controls the solenoid such that the web is taken up by rotatably driving the take-up roller in a state where the web is pressed to the conveyance roller. The web end determination unit determines whether or not an end of the web is exposed on a support roller by a take-up operation of the take-up roller. The web end determination unit determines that the end of the web is exposed on the support roller when a detection result of a detection unit is not changed in spite of a fact that supplying of electricity to the solenoid is performed.

5 Claims, 21 Drawing Sheets

(51) Int. Cl.
*G03G 15/20* (2006.01)
*G03G 21/16* (2006.01)

(52) U.S. Cl.
CPC ... *B65H 2301/531* (2013.01); *G03G 15/2025* (2013.01); *G03G 21/169* (2013.01)

(56) References Cited

U.S. PATENT DOCUMENTS

| | | | | |
|---|---|---|---|---|
| 6,616,084 | B1 * | 9/2003 | Sitzmann | B41F 35/00 242/534 |
| 9,235,186 | B2 * | 1/2016 | Hatazaki | G03G 15/2025 |
| 9,827,795 | B2 * | 11/2017 | Hara | B41J 11/007 |
| 2009/0285593 | A1 * | 11/2009 | Sakuma | G03G 21/105 399/71 |
| 2010/0232849 | A1 * | 9/2010 | Nanataki | G03G 15/2025 399/327 |
| 2012/0219335 | A1 * | 8/2012 | Kubota | G03G 15/2025 399/327 |

FOREIGN PATENT DOCUMENTS

| | | | |
|---|---|---|---|
| JP | 2006-117420 | | 5/2006 |
| JP | 2008040310 | A * | 2/2008 |

* cited by examiner

FIG.18

CONVERSION RATE RELATED INFORMATION J1

| J11 SIZE OF SHEET | J12 CONVERSION RATE |
|---|---|
| SS1 | CR1 |
| SS2 | CR2 |
| ... | ... |

FIG.19

THRESHOLD-VALUE RELATED INFORMATION J2

| J21 TIMING CONDITION | J22 PRINTING CONDITION | J23 CONVEYANCE DETERMINATION THRESHOLD VALUE |
|---|---|---|
| CT1 | CP1 | TT11 |
| | CP2 | TT12 |
| | ... | ... |
| CT2 | CP1 | TT21 |
| | CP2 | TT22 |
| | ... | ... |

FIG.21

OPERATION NUMBER SETTING INFORMATION J3

| J31 | J32 |
|---|---|
| CUMULATIVE VALUE OF NUMBER OF TIMES OF OPERATION OF SOLENOID | SET VALUE OF NUMBER OF TIMES OF OPERATION OF SOLENOID IN ONE CLEANING |
| 0 OR MORE AND LESS THAN CV1 | SV1 |
| CV1 OR MORE AND LESS THAN CV2 | SV2 |
| CV2 OR MORE AND LESS THAN CV3 | SV3 |
| ... | ... |

CLEANING DEVICE AND IMAGE FORMING APPARATUS

INCORPORATION BY REFERENCE

This application is based on Japanese Patent Application No. 2019-101715 filed with the Japanese Patent Office on May 30, 2019 and Japanese Patent Application No. 2019-175353 filed with the Japanese Patent Office on Sep. 26, 2019, the contents of which are incorporated by reference.

BACKGROUND

Field of the Invention

The present disclosure relates to a cleaning device for cleaning a conveyance roller which conveys a sheet, and an image forming apparatus which includes the cleaning device.

Related Art

In an image forming apparatus such as a printer, a sheet is conveyed to a predetermined image forming position, and an image is formed on the sheet at the image forming position. Conventionally, there has been known a pair of resist rollers which is used for feeding a sheet to an image forming position. The pair of resist rollers each has a length corresponding to a width of a sheet, and forms a nip portion through which the sheet passes. When a distal end portion of the sheet is brought into contact with the nip portion in a state where the rotation of the pair of resist rollers is stopped, skewing of the sheet is straightened. Then, when the pair of resist rollers is rotated, the sheet is conveyed into the nip portion and, thereafter, the sheet is fed out (conveyed) in accordance with appropriate image forming timing at the image forming position.

Conventionally, there has been known a cleaning device which removes paper dust adhering to a surface of each resist roller. In such a cleaning device, a rolled body formed of a web wound in a roll shape is supported by a support roller, and the web is taken up by a take-up roller from the support roller. Accordingly, a new web surface is brought into contact with a surface of the resist roller so that paper dust is removed.

In the above-mentioned prior art, out of the pair of resist rollers, the web is brought into contact with the surface of the resist roller disposed on a lower side, and the web cleans the surface. Each time the resist roller is cleaned by the web, a web take-up operation is performed by the take-up roller, and a portion of the web which is brought into contact with the resist roller changes.

SUMMARY

A cleaning device according to an aspect of the present disclosure is capable of cleaning a surface of a conveyance roller that is rotatably supported on an apparatus body of an image forming apparatus and is configured to convey a sheet. The cleaning device includes a strip-shaped web, a support roller, a take-up roller, a pressing roller, a solenoid, a displacement member, a detection unit, and a controller.

The strip-shaped web cleans the surface of the conveyance roller by being brought into contact with the surface of the conveyance roller. The support roller supports a rolled body formed of the web. The take-up roller is rotatably driven, and takes up the web while pulling out the web from the support roller. The pressing roller is brought into contact with the web between the support roller and the take-up roller, and presses the web to the conveyance roller. The solenoid is operated with supplying of electricity to the solenoid and rotatably drives the take-up roller. The displacement member is displaced by an operation of the solenoid and has a detection piece fixedly mounted on the displacement member. The detection unit detects the detection piece when the detection piece is disposed in a predetermined detection region corresponding to a displacement of the displacement member. The controller controls cleaning of the conveyance roller by the web.

The controller includes a take-up control unit and a web end determination unit. The take-up control unit controls an operation of the solenoid such that a take-up operation where the web is taken up by rotatably driving the take-up roller is performed in a state where the web is pressed to the conveyance roller by the pressing roller. The web end determination unit determines whether or not an end of the web is exposed on the support roller by the take-up operation of the take-up roller based on a state of supplying of electricity to the solenoid and a detection result of the detection unit. The web end determination unit determines that the end of the web is exposed on the support roller when the detection result of the detection unit is not changed in spite of a fact that supplying of electricity to the solenoid is performed.

An image forming apparatus according to another aspect of the present disclosure includes: an apparatus body; a conveyance roller configured to be rotatably supported on the apparatus body and to convey a sheet; an image forming unit configured to form an image on the sheet; and the above-mentioned cleaning device configured to clean the conveyance roller.

BRIEF DESCRIPTION OF THE DRAWINGS

FIG. 18 is a table showing conversion rate related information stored in a memory unit of a cleaning control part in a controller of the image forming apparatus;

FIG. 19 is a table showing threshold-value related information stored in the memory unit;

FIG. 21 is a table showing operation number setting information stored in the memory unit.

DETAILED DESCRIPTION

Hereinafter, a cleaning device and an image forming apparatus according to an embodiment of the present disclosure are described with reference to drawings.

Figure 1:
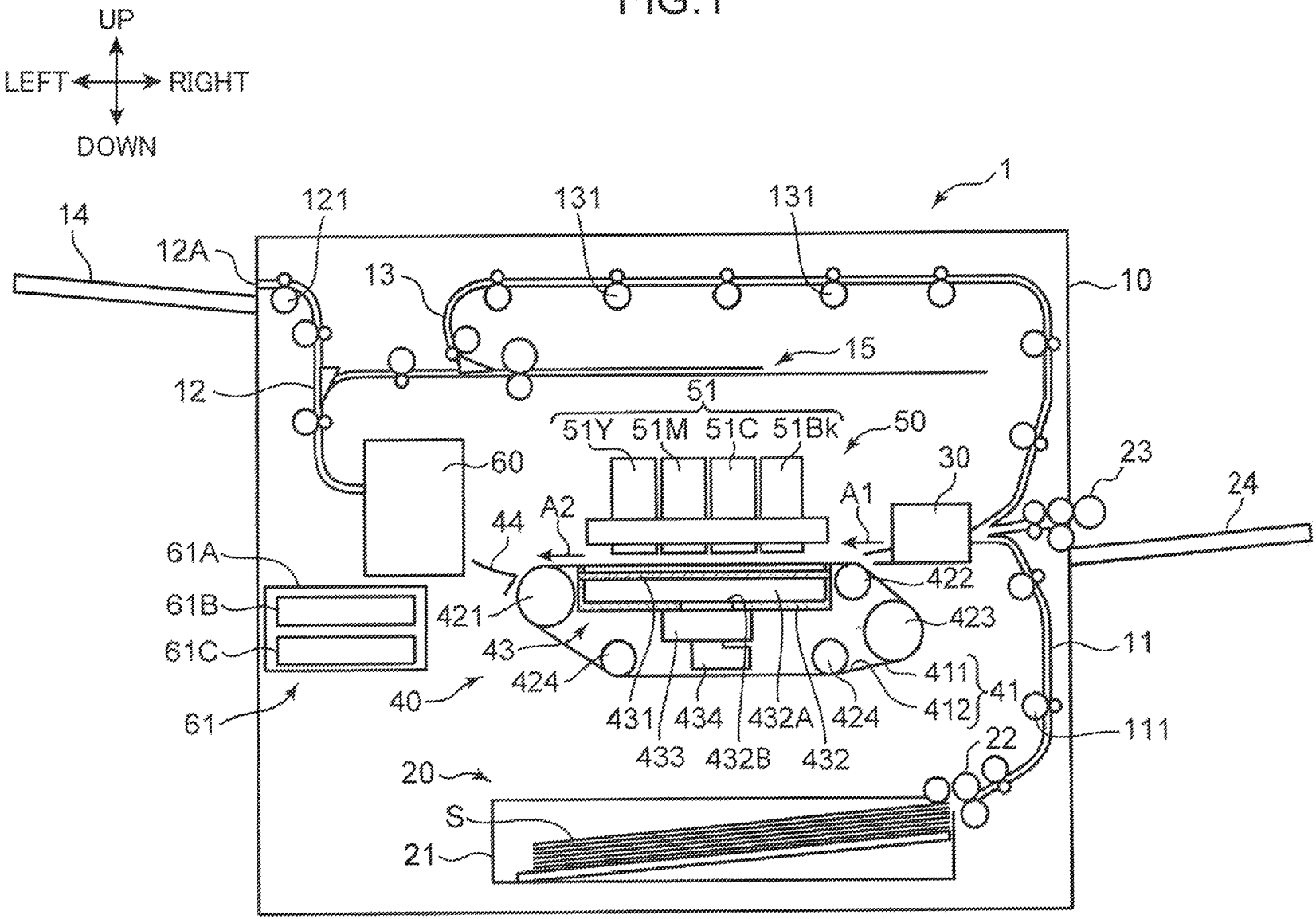
FIG. 1 is a schematic cross-sectional view showing an internal structure of an image forming apparatus according to an embodiment of the present disclosure.

FIG. 1 is a schematic cross-sectional view showing an internal structure of an image forming apparatus 1 according to the embodiment of the present disclosure. The image forming apparatus 1 shown in FIG. 1 is an ink jet recording apparatus which forms (records) an image on a sheet S by ejecting ink droplets. The image forming apparatus 1 includes an apparatus body 10, a paper supply unit 20, a resist roller unit 30, a belt conveyance unit 40, an image forming unit 50, a curl correction unit 60, and a maintenance unit 61.

The apparatus body 10 is a box-shaped housing that houses various devices for forming an image on the sheet S. In the apparatus body 10, a first conveyance path 11, a second conveyance path 12, and a third conveyance path 13 which form a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 is disposed on a right side of an upper end portion of the paper supply cassette 21. The paper supply roller 22 conveys the sheet S stored in the paper supply cassette 21 to a downstream side of the first conveyance path 11.

The sheet S supplied to the first conveyance path 11 is conveyed to the resist roller unit 30 disposed on a downstream end of the first conveyance path 11 by a pair of first conveyance rollers 111 disposed on the first conveyance path 11. A paper supply tray 24 is disposed on a right side surface of the apparatus body 10, and sheets S can be placed on an upper surface of the paper supply tray 24. The sheets S placed on the paper supply tray 24 are fed out toward the resist roller unit 30 by the paper supply roller 23.

The resist roller unit 30 is a device which conveys the sheet S conveyed by way of the first conveyance path 11 or the paper supply roller 23 toward a conveyance belt 41 of the belt conveyance unit 40 in a sheet conveyance direction A1. The resist roller unit 30 and the belt conveyance unit 40 convey the sheet S at different positions. Details of the resist roller unit 30 are described later.

The sheet S conveyed by the resist roller unit 30 is conveyed by the belt conveyance unit 40 in a sheet conveyance direction A2. The sheet conveyance directions A1 and A2 are leftward directions in FIG. 1.

The belt conveyance unit 40 is disposed below the image forming unit 50. The belt conveyance unit 40 conveys the sheet S conveyed by the resist roller unit 30 in the sheet conveyance direction A2 toward the curl correction unit 60 such that the sheet S passes below the image forming unit 50. The belt conveyance unit 40 includes the conveyance belt 41, a first support roller 421, a second support roller 422, a third support roller 423, a pair of fourth support rollers 424, and a suction unit 43.

The conveyance belt 41 is an endless belt having a predetermined width in a front-rear direction and extending in a left-right direction. The conveyance belt 41 is disposed so as to opposedly face the image forming unit 50, and conveys the sheet S in the sheet conveyance direction A2 on an outer peripheral surface 411. An image forming position where an image is formed on the sheet S by the image forming unit 50 is set on an orbital movement path of the conveyance belt 41.

The conveyance belt 41 is supported in an extended manner between and by the first support roller 421, the second support roller 422, the third support roller 423, and the pair of fourth support rollers 424. The suction unit 43 is disposed inside the conveyance belt 41 which is supported in an extended manner as described above in a state where the suction unit 43 opposedly faces an inner peripheral surface 412 of the conveyance belt 41. The first support roller 421 is rotatably driven by a drive motor (not shown), and allows the conveyance belt 41 to orbit in a predetermined orbital direction. The conveyance belt 41 has a plurality of suction holes penetrating the conveyance belt 41 in a thickness direction from the outer peripheral surface 411 to the inner peripheral surface 412.

The suction unit 43 is disposed so as to opposedly face the image forming unit 50 with the conveyance belt 41 interposed therebetween. The suction unit 43 brings the sheet S into close contact with the outer peripheral surface 411 of the conveyance belt 41 by generating a negative pressure between the sheet S held on the outer peripheral surface 411 of the conveyance belt 41 and the conveyance belt 41. The suction unit 43 includes a belt guide member 431, a suction housing 432, a suction device 433, and an exhaust duct 434.

The belt guide member 431 guides the orbital movement of the conveyance belt 41 in an interlocking manner with the rotation of the first support roller 421 between the first support roller 421 and the second support roller 422.

The suction unit 43 generates a suction force by sucking air from a space above the conveyance belt 41 through a groove portion and a through hole formed in the belt guide member 431 and the suction holes of the conveyance belt 41. Due to such a suction force, an airflow (suction air) toward the suction unit 43 is generated in a space formed above the conveyance belt 41. When the sheet S is conveyed onto the conveyance belt 41 by the resist roller unit 30 and covers a part of the outer peripheral surface 411 of the conveyance belt 41, a suction force (negative pressure) acts on the sheet S, and the sheet S is brought into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431.

An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed in the apparatus body 10.

The image forming unit 50 is disposed above the belt conveyance unit 40. The image forming unit 50 forms an image by applying image forming processing to the sheet S which is conveyed in the sheet conveyance direction A2 in a state where the sheet S is held on the outer peripheral surface 411 of the conveyance belt 41. In the this embodiment, an image forming method of the image forming unit 50 is an ink jet method, and an image is formed on the sheet S by ejecting ink droplets.

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacently to each other from the upstream side to the downstream side in the sheet conveyance direction A1.

The line heads 51 form an image on the sheet S by ejecting ink droplets on the sheet S conveyed in the sheet conveyance direction A2 in a state where the sheet S is held on the outer peripheral surface 411 of the conveyance belt 41. As a result, an image is formed on the sheet S.

The sheet S on which the image is formed is conveyed by the conveyance belt 41, and is discharged (fed out) toward the curl correction unit 60 while being guided by a sheet discharge guide unit 44. The curl correction unit 60 is disposed downstream of the conveyance belt 41 in the sheet conveyance direction A2 with the sheet discharge guide unit 44 sandwiched therebetween. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

On the other hand, in a case where both-side printing is performed on the sheet S, the sheet S on which the image forming processing of a first surface (front surface) has been completed is fed out from the second conveyance path 12 to a sheet reversing unit 15. The sheet reversing unit 15 is a conveyance path branched from a middle portion of the second conveyance path 12, and is a part where the sheet S is reversed (switched back). The sheet S where the front surface and the back surface are reversed by the sheet reversing unit 15 is fed out to the third conveyance path 13. The sheet S fed out to the third conveyance path 13 is reversely fed by a pair of third conveyance rollers 131 provided in the third conveyance path 13, and is supplied again onto the outer peripheral surface 411 of the conveyance belt 41 by way of the resist roller unit 30 in a state where the front surface and the back surface of the sheet S are reversed. With respect to the sheet S supplied onto the outer peripheral surface 411 of the conveyance belt 41 in a state where the front surface and the back surface of the sheet S are reversed as described above, the image forming processing is applied to a second surface (back surface) on a side opposite to the first surface of the sheet S by the image forming unit 50 while being conveyed by the conveyance belt 41. The sheet S on which both-side printing has been completed passes through the second conveyance path 12, and is discharged onto the paper discharge unit 14 from the paper discharge port 12A.

In the image forming apparatus 1, the inks are ejected from the line heads 51 when the image forming processing for forming an image on the sheet S is performed. On the other hand, when maintenance processing for the line heads 51 is performed during stoppage of the image forming processing applied to the sheet S, purge processing is performed for discharging the pressurized inks from the line heads 51. The maintenance processing for the line heads 51 is performed by the maintenance unit 61 shown in FIG. 1. The maintenance unit 61 includes a cap unit 61B and a wipe unit 61C mounted in a carriage 61A. Details of the configuration of the maintenance unit 61 and details of the maintenance processing for the line heads 51 are described later.

Figure 2:
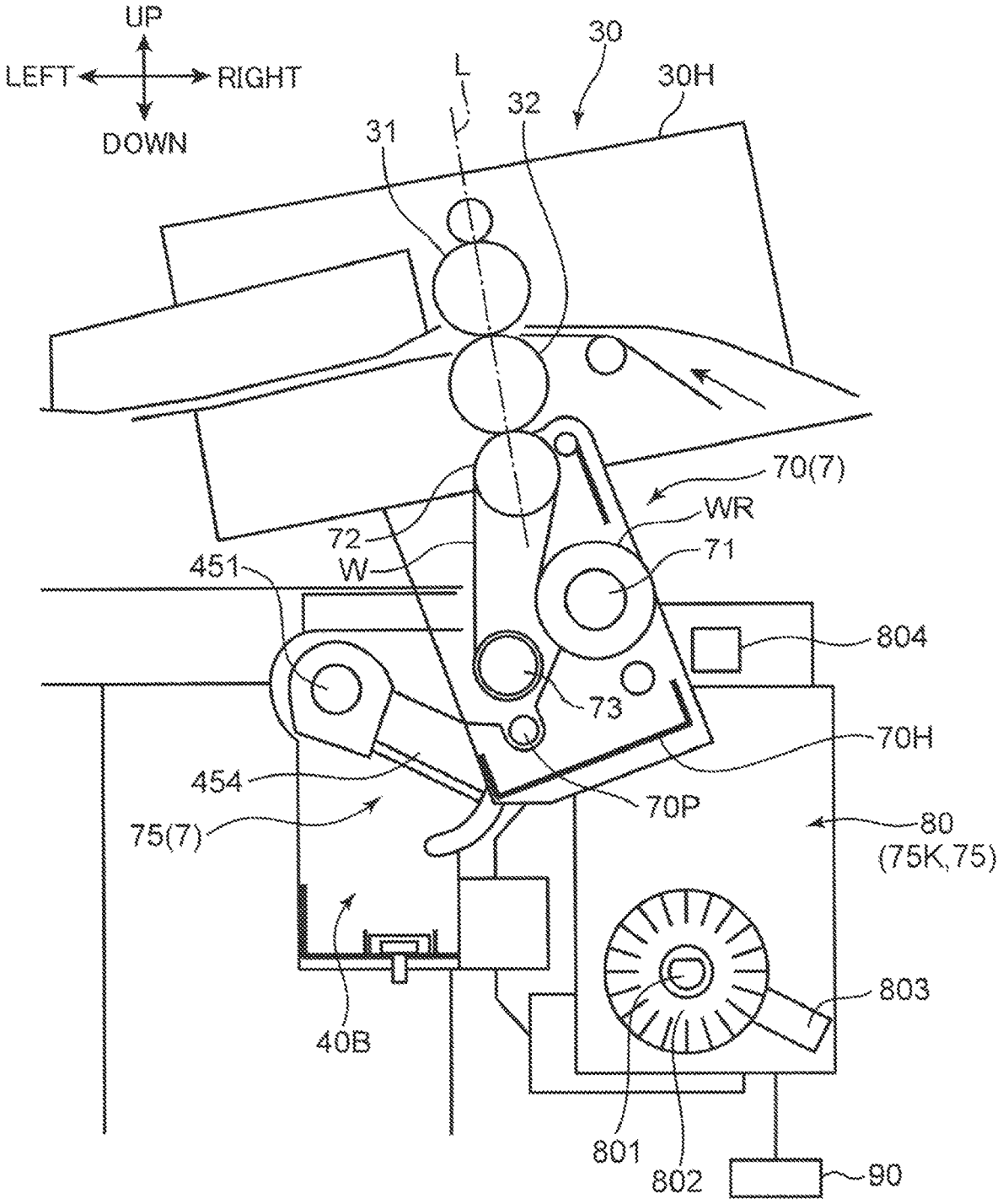
FIG. 2 is a cross-sectional view of a pair of resist rollers, a cleaning unit of the image forming apparatus and the surrounding of these parts, and is also a cross-sectional view showing a state where the cleaning unit is disposed at a cleaning position.

FIG. 2 is a cross-sectional view of the pair of resist rollers, the cleaning unit 70 of the image forming apparatus 1 and the surrounding of these parts according to the present embodiment, and is a cross-sectional view showing a state where the cleaning unit 70 is disposed at a cleaning position.

The above-described resist roller unit 30 has a resist housing 30H and a pair of resist rollers consisting of a resist upper roller 31 and a resist lower roller 32 (conveyance rollers). The resist housing 30H is mounted on the apparatus body 10, and rotatably supports the resist upper roller 31 and the resist lower roller 32. The sheet S is conveyed into a nip portion formed between the pair of resist rollers as indicated by an arrow in FIG. 2 in the resist housing 30H. The resist roller unit 30 has a resist driving unit 30M (see FIG. 16 described later) which rotatably drives the resist upper roller 31 and the resist lower roller 32.

The resist upper roller 31 is a roller disposed on an upper side out of the pair of resist rollers. The resist upper roller 31 is formed of a metal roller.

The resist lower roller 32 is a roller disposed on a lower side out of the pair of resist rollers. The resist lower roller 32 is formed of a rubber roller, and a tetrafluoroethylene-perfluoroalkoxy ethylene copolymer resin (PFA) tube is wound around (fitted in) an outer peripheral surface of the resist lower roller 32.

As shown in FIG. 2, a straight line L connecting the center of the resist upper roller 31 and the center of the resist lower roller 32 is inclined at an acute angle (for example, 10 degrees) with respect to a vertical direction. In other words, the resist lower roller 32 is disposed at the position displaced upstream in a conveyance direction of the sheet S with respect to the resist upper roller 31.

Figure 14:
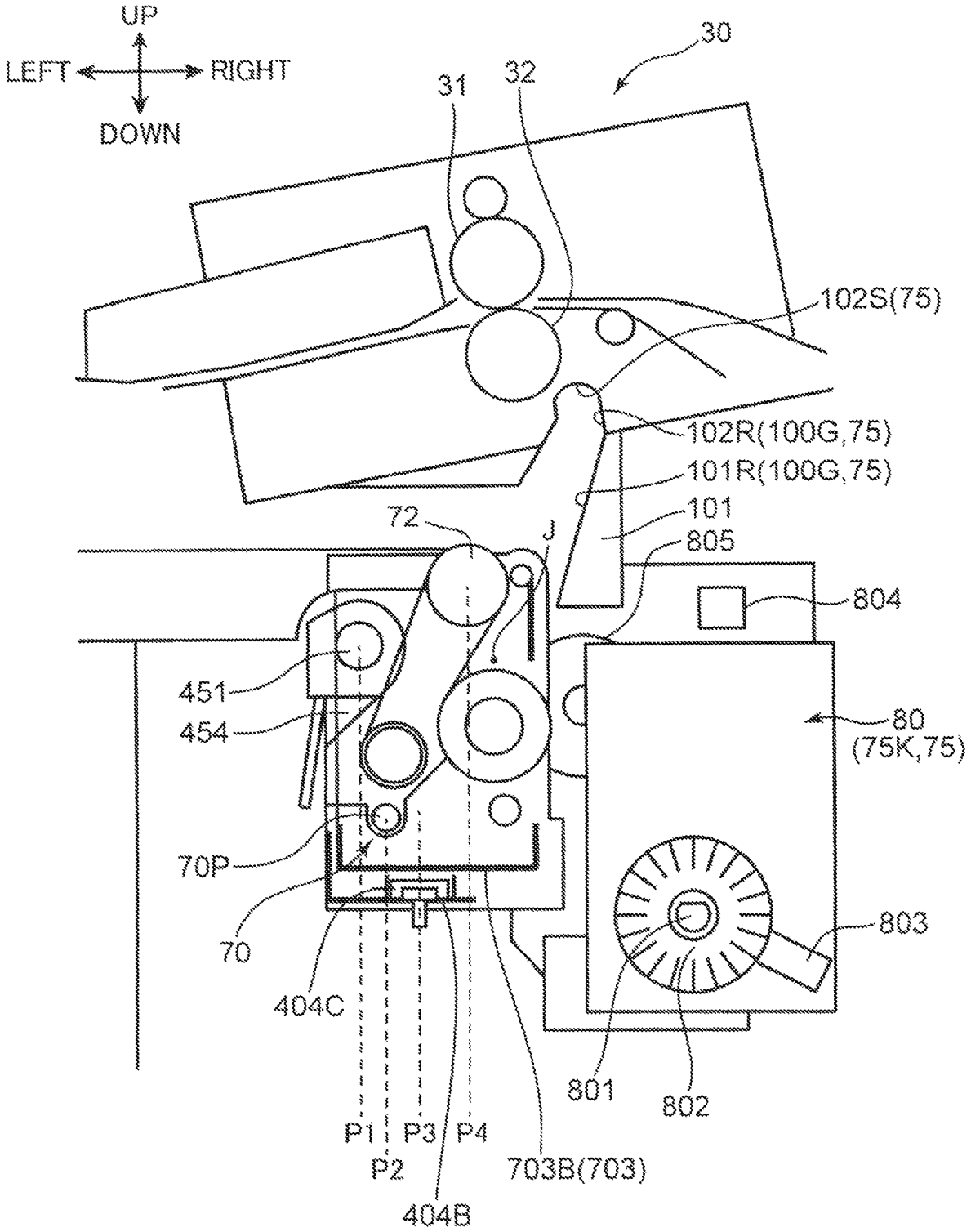
FIG. 14 is a cross-sectional view of the pair of resist rollers, the cleaning unit of the image forming apparatus and the surrounding of these parts, and is also a cross-sectional view showing a state where the cleaning unit is disposed at a mounting and removing position.
Figure 15:
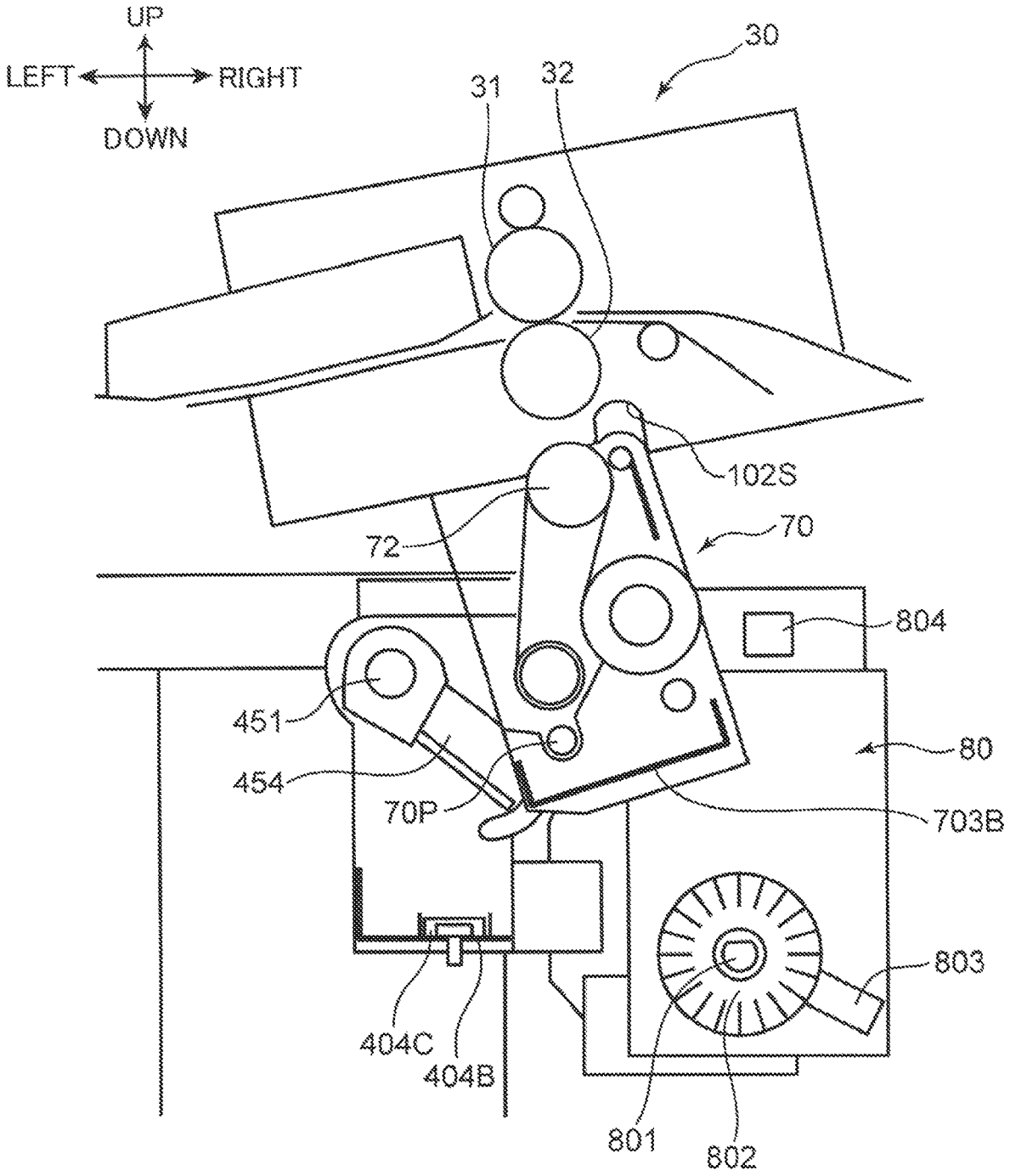
FIG. 15 is a cross-sectional view of the pair of resist rollers, the cleaning unit of the image forming apparatus and the surrounding of these parts, and is also a cross-sectional view showing a state where the cleaning unit is disposed at a separation position.

Further, the image forming apparatus 1 includes a cleaning device 7. The cleaning device 7 can clean a surface of the resist lower roller 32. The cleaning device 7 has the cleaning unit 70 and a movement mechanism 75 (see FIG. 9). The movement mechanism 75 has a function of moving the cleaning unit 70 between the cleaning position (FIG. 2), a mounting and removing position (FIG. 14), and a separation position (FIG. 15).

Figure 3:
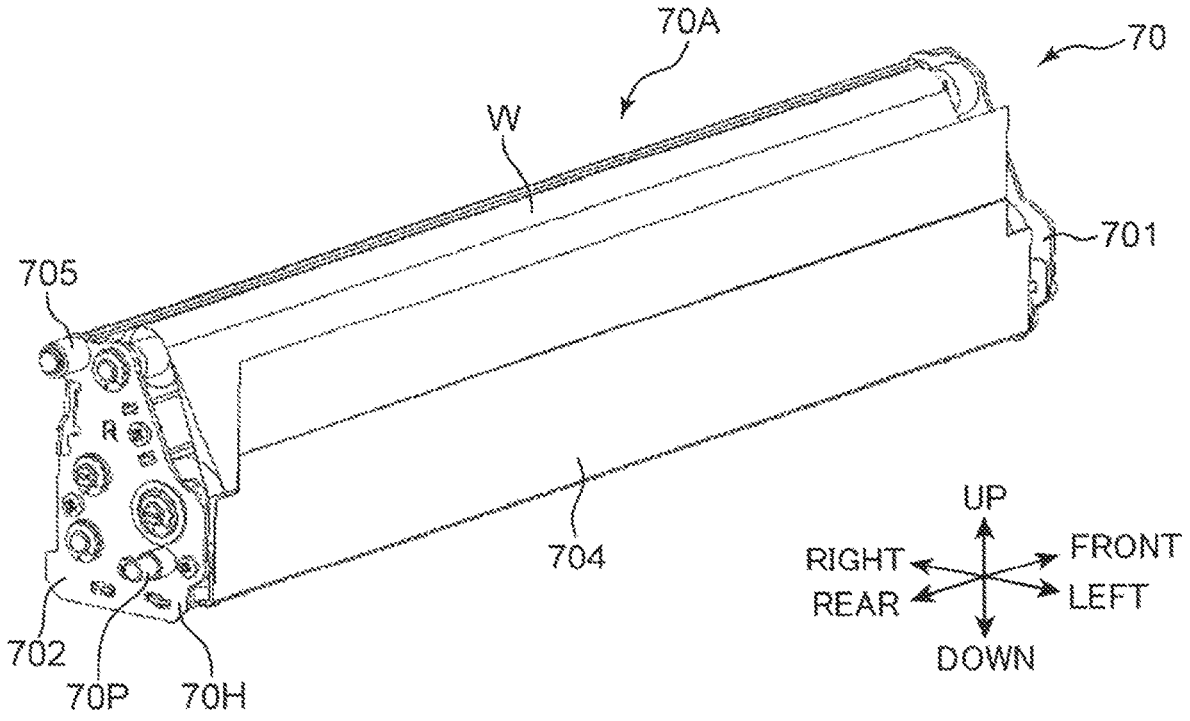
FIG. 3 is a perspective view of the cleaning unit.
Figure 4:
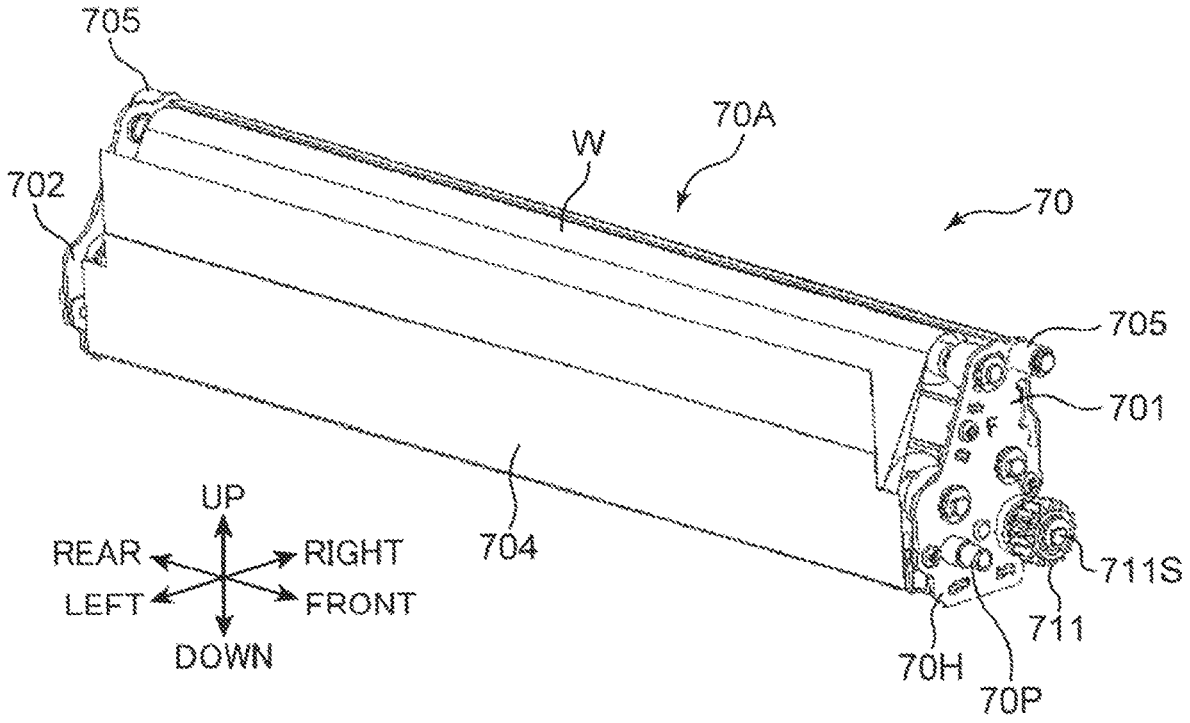
FIG. 4 is a perspective view of the cleaning unit.
Figure 5:
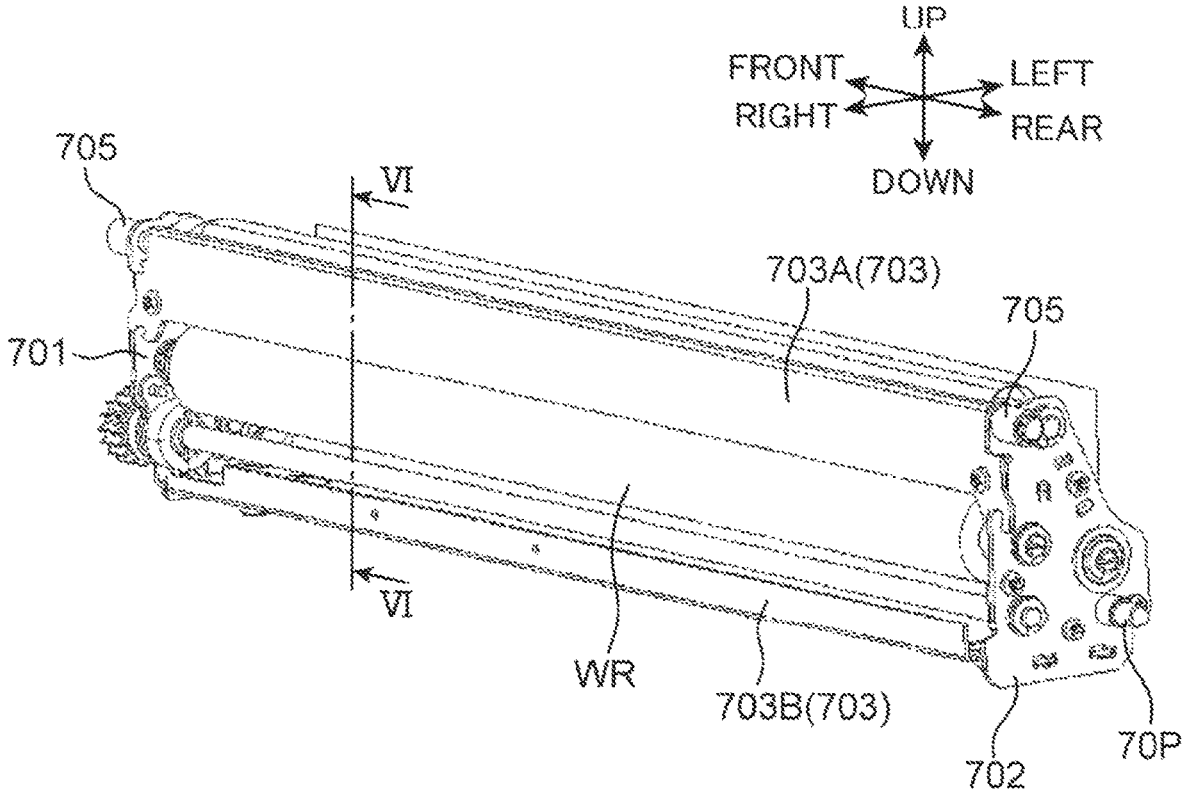
FIG. 5 is a perspective view of the cleaning unit.
Figure 6:
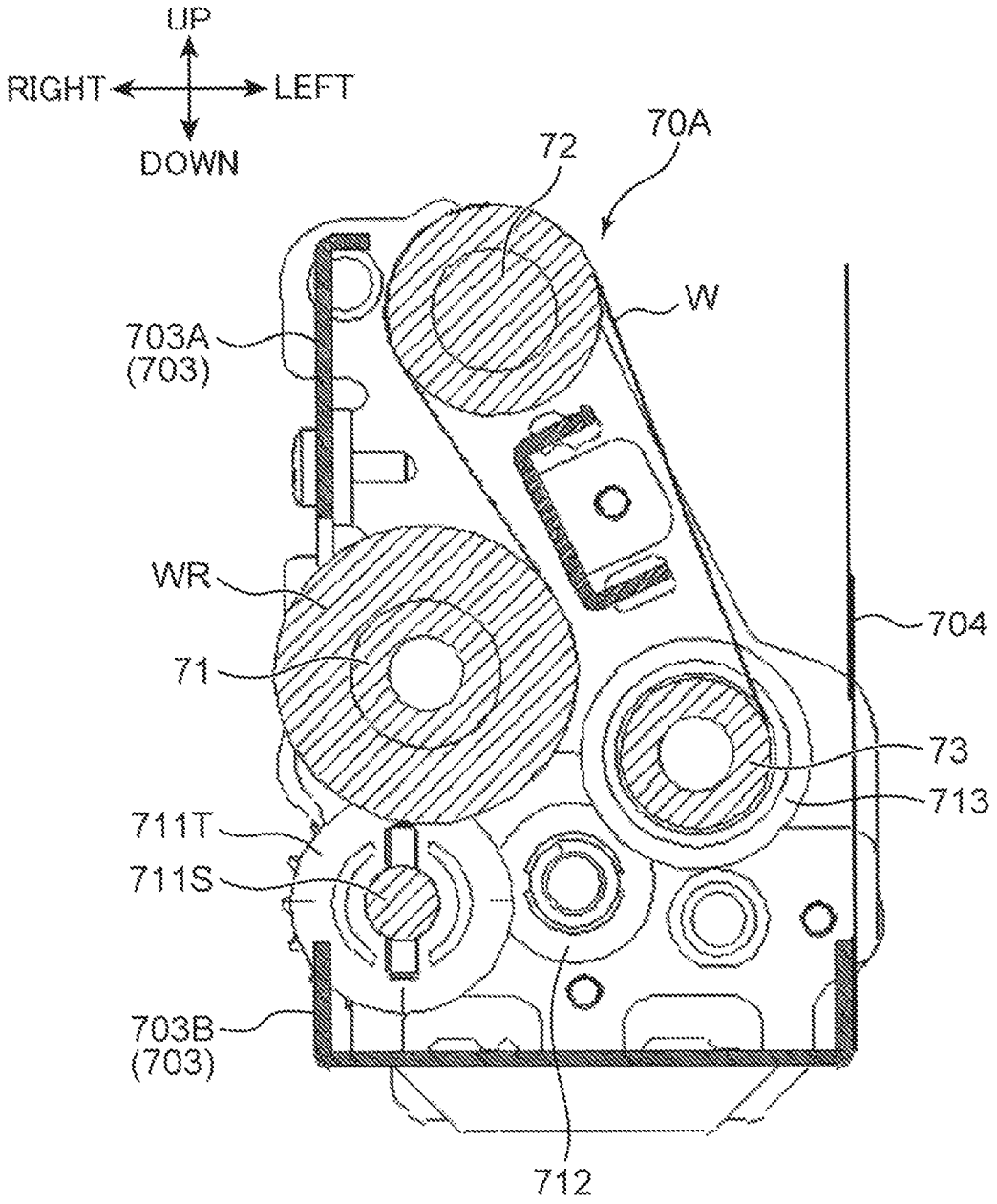
FIG. 6 is a cross-sectional view taken along line VI-VI in FIG. 5.

FIGS. 3 to 5 are perspective views of the cleaning unit 70 of the image forming apparatus 1 according to the present embodiment. FIG. 6 is a cross-sectional view taken along line VI-VI in FIG. 5.

The cleaning unit 70 has a cleaning part 70A and a cleaning housing 70H. The cleaning part 70A has a shape extending along an axial direction of the resist lower roller 32, and is brought into contact with a surface of the resist lower roller 32 from below so as to clean the surface of the resist lower roller 32.

The cleaning housing 70H supports the cleaning part 70A. The cleaning housing 70H has a front wall 701 and a rear wall 702, a connection wall 703, a pair of unit fulcrum pins 70P, a sheet member 704, and a pair of guide rollers 705. The front wall 701, the rear wall 702, and the connection wall 703 of the cleaning housing 70H are made of a metal material (magnetic material).

The front wall 701 and the rear wall 702 are disposed so as to opposedly face each other in the front-rear direction (axial direction of the resist lower roller 32) and support the cleaning part 70A. The connection wall 703 connects the front wall 701 and the rear wall 702 along the front-rear direction. The connection wall 703 has a side wall 703A and a bottom wall 703B (FIGS. 5 and 6). A pair of front and rear ribs 703T are formed on the bottom wall 703B in a protruding manner (see FIGS. 12 and 13).

The pair of unit fulcrum pins 70P is formed on the front wall 701 and the rear wall 702 in a protruding manner from outer surfaces of the front wall 701 and the rear wall 702 in the front-rear direction respectively. The unit fulcrum pins 70P are disposed on left lower portions of the front wall 701 and the rear wall 702 respectively. Each unit fulcrum pin 70P has a circular cylindrical shape in two stages where an outer diameter of the unit fulcrum pin 70P decreases toward a distal end portion.

The sheet member 704 is fixed to the bottom wall 703B so as to define a left side surface of the cleaning unit 70 (FIG. 6). The sheet member 704 prevents a collected matter such as paper dust collected by the cleaning unit 70 from scattering toward the belt conveyance unit 40 (FIG. 1).

The pair of guide rollers 705 is supported by the front wall 701 and the rear wall 702 above the unit fulcrum pins 70P respectively, and each guide roller 705 includes an outer peripheral surface which is rotatable about a center axis parallel to the front-rear direction. The guide rollers 705 are disposed on right upper portions of the front wall 701 and the rear wall 702 respectively. The pair of guide rollers 705 has a function of guiding the cleaning unit 70 when the cleaning unit 70 moves to the mounting and removing position, the separation position, and the cleaning position described above.

The cleaning part 70A includes: a web W; a web driven roller 71 (support roller) rotatably supported by the front wall 701 and the rear wall 702; a pressing roller 72; and a web drive roller 73 (take-up roller) (see FIG. 6). The web W is formed of a strip-shaped member having a contact surface capable of being brought into contact with the surface of the resist lower roller 32. The web W is formed of a cloth material such as a nonwoven fabric as an example. The web W comes into contact with the surface of the resist lower roller 32, and thus cleaning the surface of the resist lower roller 32. In the present embodiment, as shown in FIG. 6, a web roll WR which is a rolled body formed by winding the web W in a roll shape in advance is fitted on the web driven roller 71. An end of the web W is fixed to a peripheral surface of the web driven roller 71. A distal end of the web W is caught by an outer peripheral surface of the pressing roller 72 and, thereafter, the distal end of the web W is fixed to an outer peripheral surface of the web drive roller 73.

The web driven roller 71 is a support roller for supporting the web roll WR which is a rolled body formed of the web W. The web drive roller 73 is a roller which is rotatably driven, and is a take-up roller having a drive roller gear 713 as a drive input portion to which a rotational drive force is input. The web drive roller 73 takes up the web W while pulling out the web W from the web driven roller 71 due to the rotation corresponding to a rotational drive force inputted to the drive roller gear 713. The pressing roller 72 is brought into contact with a back surface of the web W between the web driven roller 71 and the web drive roller 73, and presses the front surface of the web W to the resist lower roller 32. When the cleaning unit 70 is disposed at the above-described cleaning position (FIG. 2), the pressing roller 72 is brought into contact with the resist lower roller 32 with the web W sandwiched therebetween. When the web W is pulled out from the web driven roller 71 corresponding to the rotation of the web drive roller 73, a portion of the web W which is brought into contact with the resist lower roller 32 by way of the pressing roller 72 changes.

As shown in FIG. 5, a state of the web roll WR which is supported by the web driven roller 71 can be visually recognized from the outside of the cleaning unit 70 through an opening portion formed between the side wall 703A and the bottom wall 703B. Accordingly, it is possible to prevent the cleaning unit 70 which is removed from the apparatus body 10 during use and where a feedable amount of the web W becomes small from being erroneously mounted on the apparatus body 10.

The cleaning unit 70 also has a unit input gear 711 (FIG. 4), an interlocking gear 711T, a transmission gear 712, and the above-described drive roller gear 713 (FIG. 6).

The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711.

The transmission gear 712 is rotatably supported on an inner side of the front wall 701, and engages with the interlocking gear 711T and the drive roller gear 713 respectively. The drive roller gear 713 is a gear fixed to one end portion of the web drive roller 73. The drive roller gear 713 functions as a drive input portion to which a rotational drive force for rotating the web drive roller 73 is inputted.

Figure 7:
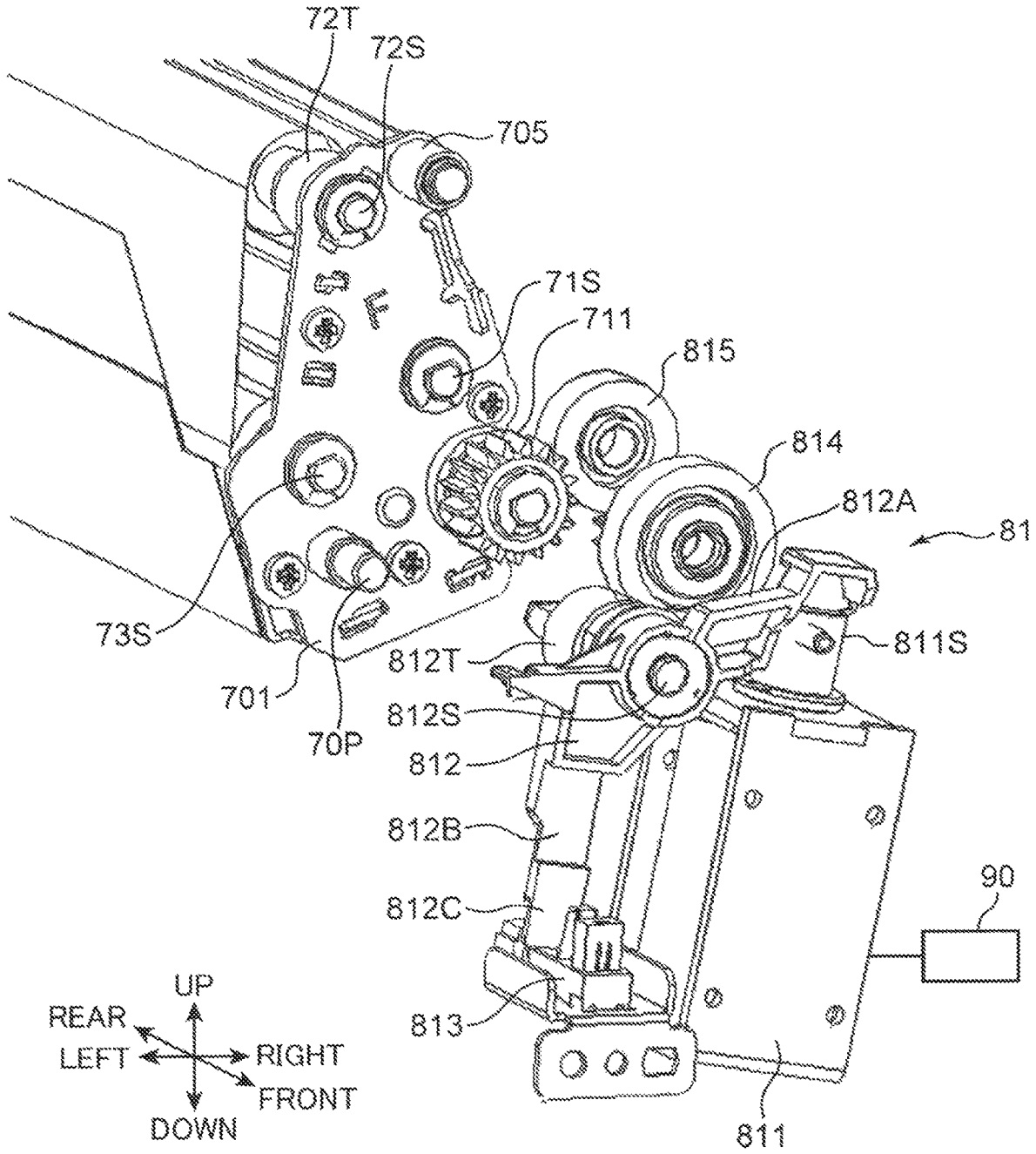
FIG. 7 is a perspective view of the cleaning unit and a web feed-out mechanism of the image forming apparatus.

FIG. 7 is a perspective view of the cleaning unit 70 and a web feed-out mechanism 81 of the image forming apparatus 1 according to the present embodiment. The cleaning device 7 further includes the web feed-out mechanism 81. The web feed-out mechanism 81 is mounted on the apparatus body 10 of the image forming apparatus 1. The web feed-out mechanism 81 has a function of feeding out the web W of the cleaning unit 70. The web feed-out mechanism 81 is connected to the cleaning unit 70 by disposing the cleaning unit 70 at the cleaning position. The web feed-out mechanism 81 has a solenoid 811, a third detection sensor 813 (detection unit), and transmission gears 814 and 815.

The solenoid 811 generates a drive force for rotating the web drive roller 73. The solenoid 811 has an extendable and retractable shaft 811S, and rotates a rotary arm 812 (rotary member). The extendable and retractable shaft 811S extends and retracts with respect to a body of the solenoid 811. The rotary arm 812 is a rotary member which is rotatably supported by the apparatus body 10. The solenoid 811 rotates the rotary arm 812 along with an extending and retracting operation of the extendable and retractable shaft 811S by supplying electricity to the solenoid 811, and outputs a rotational force of the rotary arm 812 as a rotational drive force for the drive roller gear 713 fixed to the web drive roller 73. The solenoid 811 is supported by a sheet-metal-made drive frame (not shown) which is disposed inside the apparatus body 10.

The rotary arm 812 is one example of a displacement member which is displaced by the operation of the solenoid 811. The rotary arm 812 is rotatably supported on a shaft 812S (FIG. 7) provided to the drive frame disposed inside the apparatus body 10. The shaft 812S is supported by the drive frame such that the shaft 812S is rotatable about a rotation center axis extending in the front-rear direction. The rotary arm 812 has a first arm portion 812A and a second arm portion 812B. The first arm portion 812A extends rightward from the rotation center axis of the rotary arm 812. A distal end portion of the first arm portion 812A is connected to the extendable and retractable shaft 811S. The second arm portion 812B extends toward a side opposite to the first arm portion 812A and downward from the rotation center axis of the rotary arm 812. A detection piece 812C is fixedly mounted on a distal end portion (lower end portion) of the second arm portion 812B. Note that the detection piece 812C may be fixedly mounted on the extendable and retractable shaft 811S. In this case, the extendable and retractable shaft 811S is another example of the displacement member which is displaced by the operation of the solenoid 811. A gear portion 812T which can rotate integrally with the shaft 812S is mounted on a rear end portion of the shaft 812S.

Further, the web feed-out mechanism 81 has a first one-way clutch (not shown) and a second one-way clutch (not shown). The first one-way clutch is fixedly mounted in the rotary arm 812 and is fitted on the shaft 812S. The second one-way clutch is fixed to the drive frame in a state where the second one-way clutch is disposed adjacently to the first one-way clutch, and is fitted on the shaft 812S.

The third detection sensor 813 is fixed to a left end portion of a body of the solenoid 811. The third detection sensor 813 is a detection unit which detects the detection piece 812C when the detection piece 812C is disposed in a predetermined detection region along with the rotation of the rotary arm 812. A displacement amount (rotation amount) of the distal end portion of the second arm portion 812B is large corresponding to an amount of the operation of the solenoid 811. Accordingly, by fixedly mounting the detection piece 812C on the distal end portion of the second arm portion 812B, the detection accuracy of the third detection sensor 813 can be improved.

The transmission gear 814 is rotatably supported by the apparatus body 10, and engages with the gear portion 812T. The transmission gear 814 is formed of a two-stage gear. In the same manner, the transmission gear 815 is rotatably supported by the apparatus body 10, and the transmission gear 815 engages with a rear gear portion of the two-stage gear of the transmission gear 814, and engages with the above-described unit input gear 711.

FIG. 7 shows a state where the extendable and retractable shaft 811S is retracted (contracted) with respect to the body of the solenoid 811. When the supplying of electricity to the solenoid 811 is stopped from the state shown in FIG. 7, the extendable and retractable shaft 811S protrudes (extends) from the body of the solenoid 811 so that the rotary arm 812 rotates in a counterclockwise direction in FIG. 7 about the shaft 812S. At this stage of the operation, the rotary arm 812 is rotated relative to the shaft 812S by an action of the above-described first one-way clutch so that there is no possibility that the shaft 812S rotates.

On the other hand, when electricity is supplied to the solenoid 811 to take up the web W by a predetermined amount, the extendable and retractable shaft 811S is contracted with respect to the body of the solenoid 811. As a result, the rotary arm 812 rotates in a clockwise direction in FIG. 7 about the shaft 812S. At this stage of the operation, the shaft 812S rotates integrally with the rotary arm 812 by a predetermined angle by an action of the above-described first one-way clutch. As a result, a rotational drive force is inputted from the gear portion 812T fixed to the shaft 812S to the unit input gear 711 by way of the transmission gear 814 and the transmission gear 815. Then, the rotational drive force is further transmitted from the unit input gear 711, to the interlocking gear 711T, the transmission gear 712, and the drive roller gear 713 of the cleaning unit 70. As a result, the web drive roller 73 rotates by a preset rotation angle, and the web W is moved so as to be taken up by the web drive roller 73. As a result, a portion of the contact surface of the web W which opposedly faces the resist lower roller 32 changes. The third detection sensor 813 detects the detection piece 812C each time the rotary arm 812 rotates by one reciprocation and hence, it is detected that the unit input gear 711 has rotated and the web W has been moved.

When the web W is moved so as to be taken up by the web drive roller 73, the supplying of electricity to the solenoid 811 is stopped, and the extendable and retractable shaft 811S protrudes again to the body of the solenoid 811. At this stage of the operation, it is possible to prevent the shaft 812S from rotating in a reverse direction by an action of the above-described second one-way clutch. Further, the one-way clutch mounted on a drive roller shaft 73S of the web drive roller 73 functions so that it is possible to prevent the web drive roller 73 from rotating in the reverse direction. By switching a state of supplying electricity to the solenoid 811 between an electricity supply state and an electricity supply stop state, the extending and retracting operation of the extendable and retractable shaft 811S is performed. The rotary arm 812 rotates corresponding to the extending and retracting operation of the extendable and retractable shaft 811S, and the web drive roller 73 rotates corresponding to the rotation of the rotary arm 812. Accordingly, the web W is moved so as to be taken up by the web drive roller 73. As described above, in the present embodiment, it is possible to feed out the web W from the web roll WR supported by the web driven roller 71 by making use of a slight extending and retracting stroke of the extendable and retractable shaft 811S of the solenoid 811. In another embodiment, the web feed-out mechanism 81 may rotatably drive the web driven roller 71 in addition to the web drive roller 73.

With reference to FIG. 7, a torque limiter 72T is mounted on a pressing roller shaft 72S of the pressing roller 72. There may be a case where clogging of the sheet S occurs in the image forming apparatus 1 in a state where the web W (the pressing roller 72) of the cleaning device 7 is brought into contact with the resist lower roller 32 and the sheet S is sandwiched between the resist upper roller 31 and the resist lower roller 32. In this case, a user attempts to remove the sheet S clogged between the resist upper roller 31 and the resist lower roller 32 by opening a predetermined cover of the apparatus body 10 of the image forming apparatus 1, and by pulling out the sheet S in a direction opposite to a direction indicated by an arrow in FIG. 2. At this stage of the operation, when a force for pulling out the sheet S is transmitted from the resist lower roller 32 to the pressing roller 72, the web W is excessively fed out from the pressing roller 72 toward the web drive roller 73. In the present embodiment, since the torque limiter 72T is mounted on the pressing roller shaft 72S, when a sudden rotational force is applied to the pressing roller 72, the rotation of the pressing roller 72 is locked and hence, feeding out of the web W can be prevented.

The movement mechanism 75 (FIG. 2) moves the cleaning unit 70 among the cleaning position (FIG. 2), the mounting and removing position below the cleaning position (FIG. 14), and the separation position (FIG. 15) located between the cleaning position and the mounting and removing position. The movement mechanism 75 allows the pressing roller 72 of the cleaning part 70A to be brought into contact with the resist lower roller 32 by way of the web W at the cleaning position. The movement mechanism 75 allows the cleaning part 70A to be disposed below the resist lower roller 32 in a separated manner at the mounting and removing position, and allows the cleaning unit 70 to be mounted on or to be removed from the apparatus body 10 at the mounting and removing position. At the separation position, the cleaning part 70A is disposed below the resist lower roller 32 in a separated manner, and the connection between the cleaning unit 70 and the above-described web feed-out mechanism 81 is released.

The movement mechanism 75 functions as a separation and contact mechanism which changes the position of the pressing roller 72 with respect to the resist lower roller 32 by moving the cleaning unit 70, and thus separating the web W and the resist lower roller 32 from each other or bringing the web W and the resist lower roller 32 into contact with each other. The movement mechanism 75 moves the cleaning unit 70 to the cleaning position, and thus bringing the web W into contact with the resist lower roller 32 due to pressing of the pressing roller 72. Further, the movement mechanism 75 moves the cleaning unit 70 to the separation position, and thus disposing the pressing roller 72 below the resist lower roller 32 in a separated manner. Accordingly, the web W is separated from the resist lower roller 32.

Figure 8:
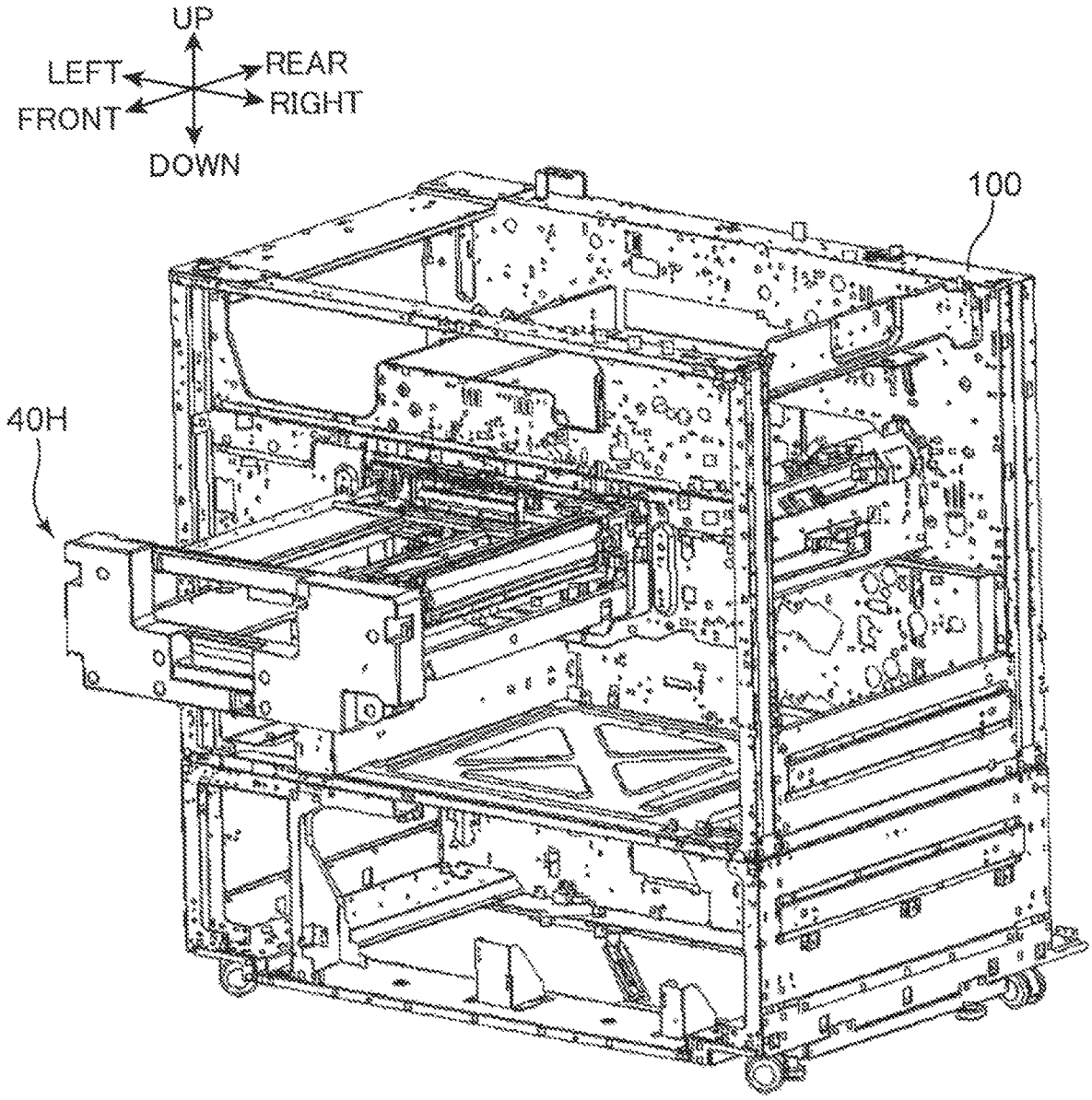
FIG. 8 is a perspective view showing a state where a conveyance unit frame is detached from a body frame which forms a part of an apparatus body of the image forming apparatus.
Figure 9:
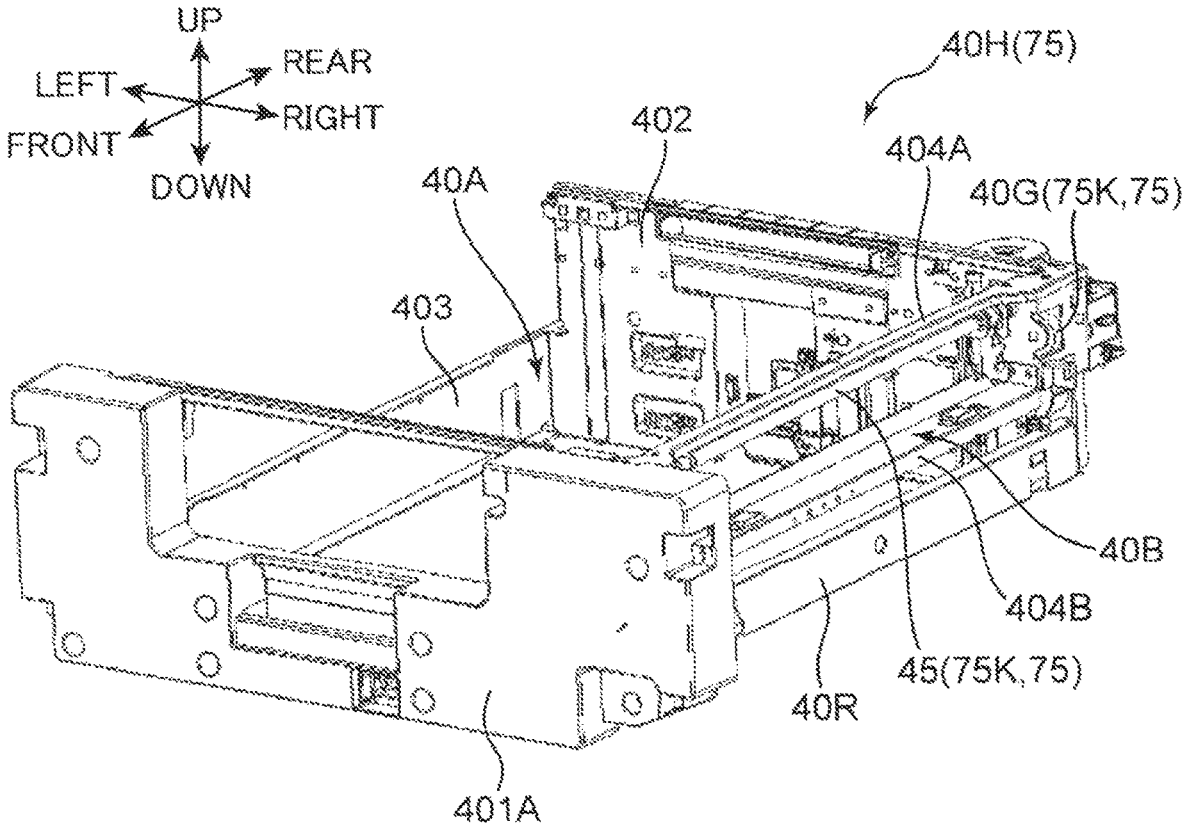
FIG. 9 is a perspective view of the conveyance unit frame.
Figure 10:
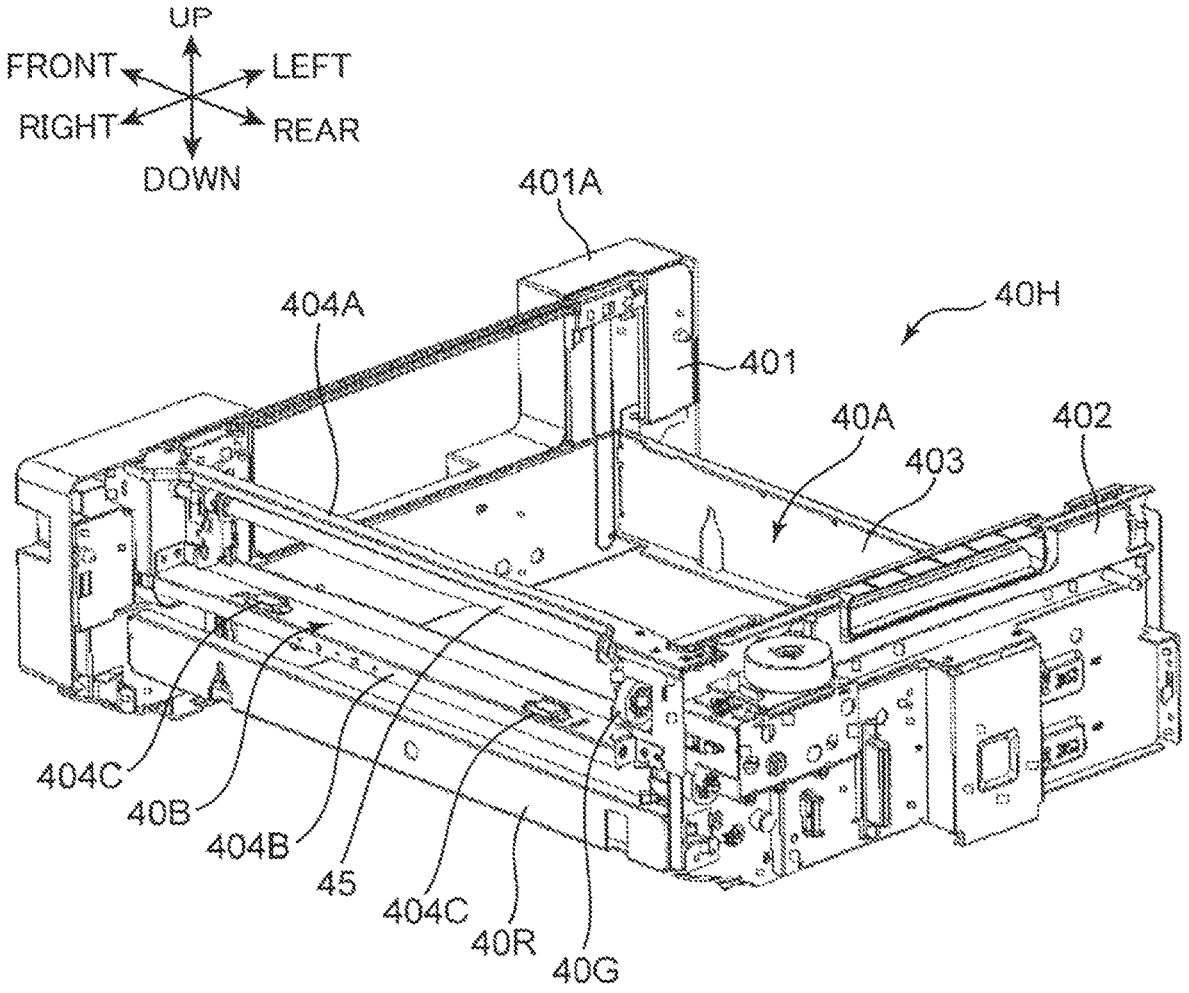
FIG. 10 is a perspective view of the conveyance unit frame.

FIG. 8 is a perspective view showing a state where a conveyance unit frame 40H is removed from the body frame 100 which forms the apparatus body 10 of the image forming apparatus 1 according to the present embodiment. FIGS. 9 and 10 are perspective views of the conveyance unit frame 40H.

The belt conveyance unit 40 shown in FIG. 1 further includes the conveyance unit frame 40H. The conveyance unit frame 40H integrally supports the conveyance belt 41, the first support roller 421, the second support roller 422, the third support roller 423, the pair of fourth support rollers 424, and the suction unit 43. The conveyance unit frame 40H can be mounted in the body frame 100 of the apparatus body 10 in a first direction (rearward direction) parallel to the front-rear direction (the axial direction of the resist lower roller 32), and can be removed from the body frame 100 along a second direction (frontward direction) opposite to the first direction.

With reference to FIGS. 9 and 10, the conveyance unit frame 40H includes a front frame 401, a rear frame 402, a left frame 403, a first right frame 404A, a second right frame 404B, and a pair of front and rear magnets 404C, and a pair of left and right rail portions 40R.

The front frame 401 is a frame disposed on a front surface portion of the conveyance unit frame 40H. A front cover 401A is mounted on the front frame 401. The front cover 401A forms a part of the front surface portion of the apparatus body 10. The rear frame 402 is a frame disposed on a rear surface portion of the conveyance unit frame 40H, and is disposed so as to opposedly face the front frame 401 in the front-rear direction. The left frame 403 is disposed on a left end portion of the conveyance unit frame 40H, and connects the front frame 401 and the rear frame 402 to each other along the front-rear direction. The first right frame 404A and the second right frame 404B are disposed on the right end portion of the conveyance unit frame 40H, and connect the front frame 401 and the rear frame 402 to each other along the front-rear direction. The first right frame 404A is disposed along an upper surface portion of the conveyance unit frame 40H, and the second right frame 404B is disposed below the first right frame 404A. Both end portions of the first right frame 404A and both end portions of the second right frame 404B in the front-rear direction are respectively connected to each other along a vertical direction by a pair of side plates (not shown) which is disposed inside the front frame 401 and the rear frame 402. As a result, a rectangular frame structure is formed by the first right frame 404A, the second right frame 404B, and the above-described pair of side plates.

The left and right rail portions 40R which form a pair are rail portions for allowing the conveyance unit frame 40H to move in a slidable manner in the front-rear direction with respect to the body frame 100. In FIGS. 9 and 10, only the right rail portion 40R is described. However, a similar rail portion 40R is disposed also at the left end portion of the conveyance unit frame 40H. The pair of magnets 404C are magnets disposed on an upper surface portion of the second right frame 404B at intervals in the front-rear direction. The pair of magnets 404C has a function of holding the cleaning unit 70.

As shown in FIGS. 9 and 10, a conveyance unit mounting portion 40A is formed, on the conveyance unit frame 40H, closer to the left side than the first right frame 404A and the second right frame 404B are. The conveyance belt 41, the first support roller 421, the second support roller 422, the third support roller 423, the pair of fourth support rollers 424, the suction unit 43, and the like are disposed in the conveyance unit mounting portion 40A. On the other hand, a cleaning unit mounting portion 40B is disposed in a space between the first right frame 404A and the second right frame 404B. The cleaning unit mounting portion 40B allows the above-described cleaning unit 70 disposed at the mounting and removing position to be mounted on the cleaning unit mounting portion 40B, and houses the cleaning unit 70. The cleaning unit mounting portion 40B forms a part of the movement mechanism 75.

Figure 11:
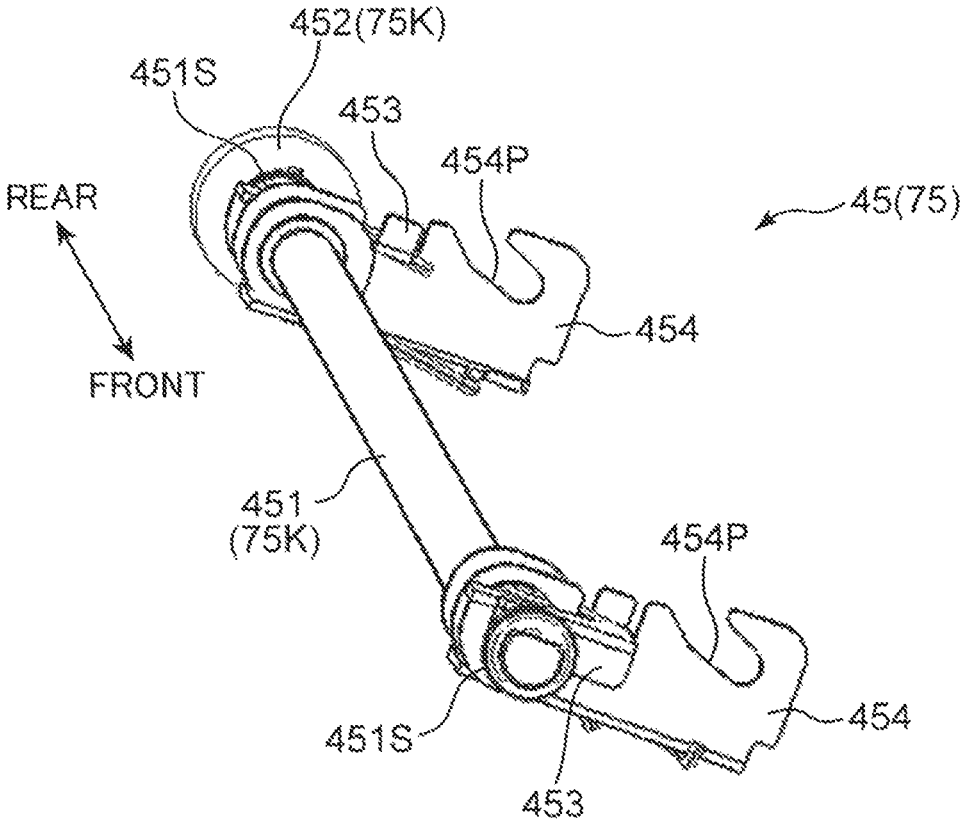
FIG. 11 is a perspective view of a cleaning unit rotating unit of the conveyance unit frame.

Further, the conveyance unit frame 40H has a cleaning unit rotating unit 45 and a rotation input gear 40G. FIG. 11 is a perspective view of the cleaning unit rotating unit 45 of the conveyance unit frame 40H according to the present embodiment.

The cleaning unit rotating unit 45 is supported by the pair of side plates just below the first right frame 404A. The cleaning unit rotating unit 45 includes a rotary shaft 451, a pair of front and rear bearings 451S, a rotary gear 452, a pair of front and rear lever support portions 453, and a pair of front and rear rotary levers 454.

The rotary shaft 451 is rotatably supported by the pair of side plates by way of the pair of front and rear bearings 451S. The rotary shaft 451 extends along the front-rear direction (the axial direction of the resist lower roller 32) and forms a center axis (first center axis) in the rotation of the pair of rotary levers 454. The rotary gear 452 is a gear fixed to a rear end portion of the rotary shaft 451, and engages with the rotation input gear 40G.

The pair of front and rear rotary levers 454 is disposed in the cleaning unit mounting portion 40B. The rotary levers 454 support the cleaning housing 70H such that the rotary levers 454 sandwich the cleaning housing 70H of the cleaning unit 70 from both sides in the front-rear direction (the axial direction of the resist lower roller 32). Pin receiving portions 454P are formed on the pair of front and rear rotary levers 454 respectively. The pin receiving portions 454P have a function of receiving the unit fulcrum pin 70P (FIGS. 3 and 4) of the cleaning unit 70 along a direction orthogonal to the front-rear direction (the axial direction of the resist lower roller 32) and a function of rotatably supporting the unit fulcrum pin 70P. The pair of front and rear lever support portions 453 is fixed to the rotary shaft 451 such that the front and rear lever support portions 453 hold the pair of rotary levers 454 respectively.

Further, the cleaning device 7 has a rotation drive unit 75K. The rotation drive unit 75K forms a part of the movement mechanism 75. The rotation drive unit 75K rotates the pair of rotary levers 454 about the center axis of the rotary shaft 451. Along with such rotation, the cleaning unit 70 moves between the cleaning position and the mounting and removing position by way of the separation position in a state where the pair of unit fulcrum pins 70P is pivotally supported on the pair of pin receiving portions 454P. The center axis is disposed above the pin receiving portion 454P in FIG. 2. Further, the rotation drive unit 75K rotates the pair of rotary levers 454 while allowing the pair of unit fulcrum pins 70P to rotate relative to the pair of pin receiving portions 454P such that the cleaning unit 70 maintains an orientation where the cleaning part 70A (web W) of the cleaning unit 70 faces upward.

The rotation drive unit 75K has a unit driving unit 80 (FIG. 2) in addition to the above-described cleaning unit rotating unit 45. The unit driving unit 80 generates a drive force for rotating the rotary shaft 451 of the cleaning unit rotating unit 45 about the center axis of the rotary shaft 451. With reference to FIG. 2, the unit driving unit 80 includes a motor (not shown) including a drive motor output shaft 801, a pulse plate 802, a first detection sensor 803, a second detection sensor 804, and a unit drive output gear 805 (FIG. 14).

The pulse plate 802 is fixed to the drive motor output shaft 801, and rotates integrally with the drive motor output shaft 801. The first detection sensor 803 detects a rotation amount of the pulse plate 802. Specifically, the first detection sensor 803 includes a light emitting part for emitting detection light, and a light receiving part for receiving the detection light. A plurality of slits which open at intervals along the rotation direction of the pulse plate 802 are formed in the pulse plate 802. Along with the rotation of the pulse plate 802, the detection light is blocked by the slits, and the light receiving part outputs a signal corresponding to a waveform of the detection light and hence, a rotation amount of the drive motor output shaft 801 (the pair of rotary levers 454) is detected.

The second detection sensor 804 is formed of a publicly known PI sensor, and detects that the cleaning unit 70 is disposed at the cleaning position shown in FIG. 2. In the present embodiment, when a part of the cleaning housing 70H of the cleaning unit 70 enters between the light emitting part and the light receiving part of the second detection sensor 804, the second detection sensor 804 detects the cleaning unit 70.

The unit drive output gear 805 transmits a rotational drive force generated by the motor of the unit driving unit 80 to the rotation input gear 40G of the cleaning unit rotating unit 45. In the present embodiment, when the conveyance unit frame 40H is mounted on the body frame 100, the rotation input gear 40G and the unit drive output gear 805 engage with each other, and a rotational drive force can be transmitted.

Figure 12:
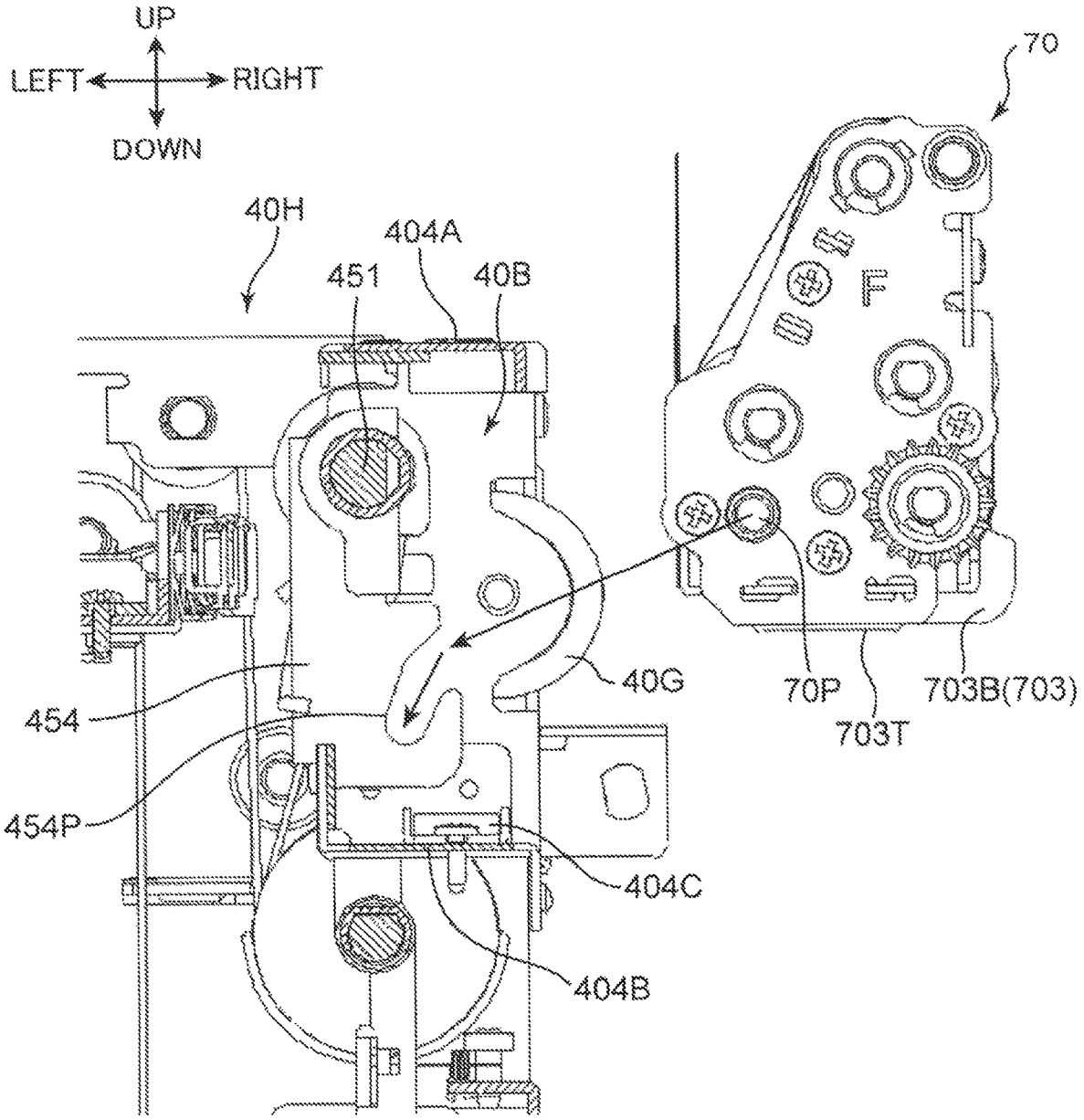
FIG. 12 is a cross-sectional view showing a state where the cleaning unit is to be mounted on the conveyance unit frame.
Figure 13:
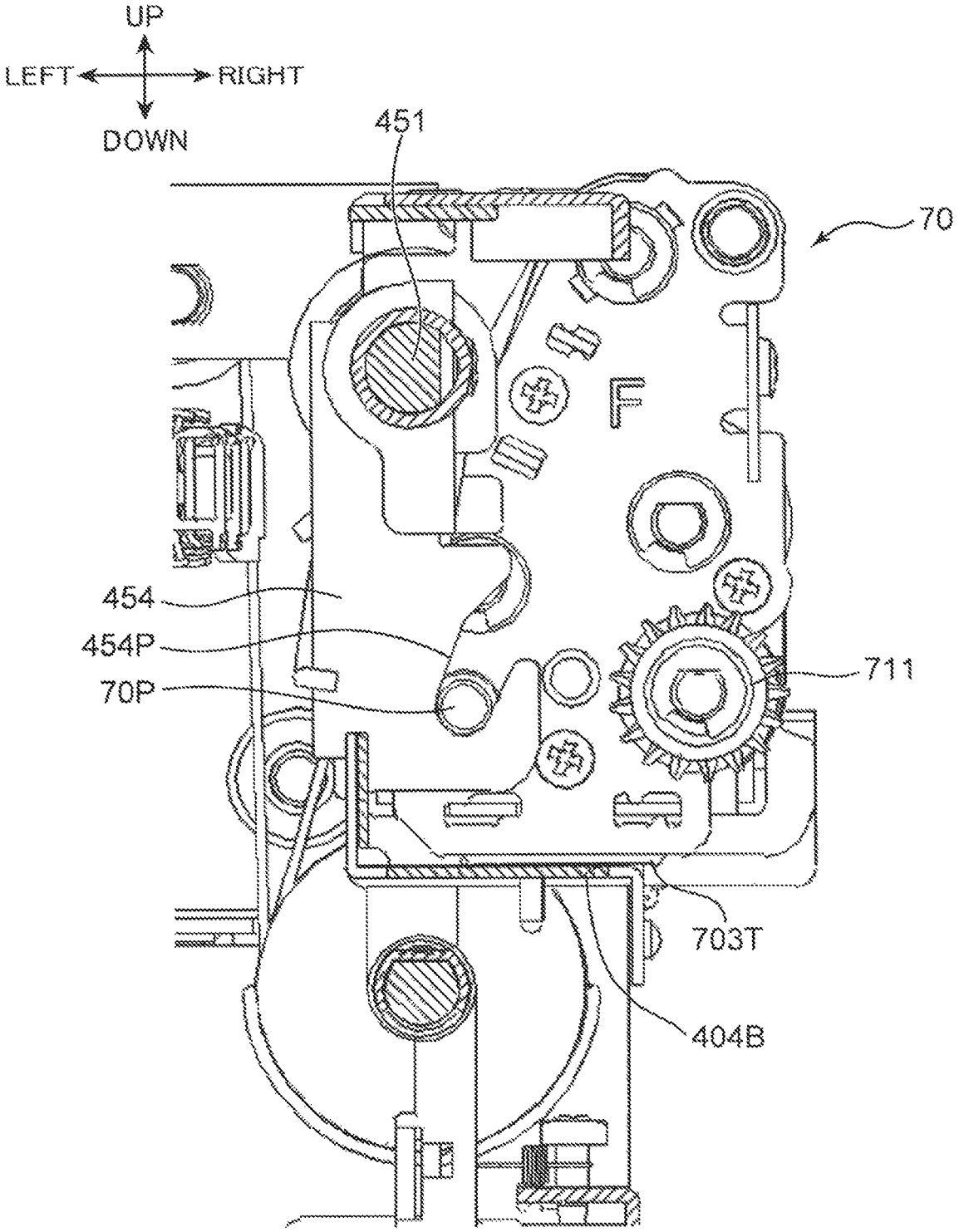
FIG. 13 is a cross-sectional view showing a state where the cleaning unit is mounted on the conveyance unit frame.

FIG. 12 is a cross-sectional view showing a state where the cleaning unit 70 is to be mounted on the conveyance unit frame 40H according to the present embodiment. FIG. 13 is a cross-sectional view showing a state where the cleaning unit 70 is mounted on the conveyance unit frame 40H. FIG. 14 is a cross-sectional view of the pair of resist rollers, the cleaning unit 70 of the image forming apparatus 1 and the surrounding of these parts, and is also a cross-sectional view showing a state where the cleaning unit 70 is disposed at a mounting and removing position. FIG. 15 is a cross-sectional view of the pair of resist rollers, the cleaning unit 70 of the image forming apparatus 1 and the surrounding of these parts, and is also a cross-sectional view showing a state where the cleaning unit 70 is disposed at the separation position.

With reference to FIG. 14, the movement mechanism 75 further includes a guide portion 100G. The guide portion 100G allows the pair of guide rollers 705 to be brought into contact with the guide portions 100G along with the rotation of the pair of rotary levers 454 about the first center axis, and guides the cleaning unit 70 between the cleaning position and the mounting and removing position. The guide portion 100G has a pair of front and rear first guide surfaces 101R and a pair of front and rear second guide surfaces 102R. The pair of front and rear first guide surfaces 101R is formed of left side surfaces of a pair of front and rear guide frames 101 which the body frame 100 includes. The first guide surface 101R is inclined such that the first guide surface 101R guides the cleaning unit 70 (guide roller 705) rightward as the first guide surface 101R extends upward. In the same manner, the pair of front and rear second guide surfaces 102R is formed of parts of the pair of front and rear resist frames which the body frame 100 includes. The second guide surface 102R is slightly inclined such that the second guide surface 102R guides the cleaning unit 70 (guide roller 705) leftward as the second guide surface 102R extends upward.

The movement mechanism 75 has a pair of front and rear positioning portions 102S. The positioning portion 102S is brought into contact with the guide roller 705 of the cleaning unit at the cleaning position and thus positioning the cleaning unit 70 such that the web W of the cleaning part 70A can clean the resist lower roller 32. As shown in FIG. 14, the positioning portion 102S is connected to the second guide surface 102R, and has an arc shape which extends along an outer peripheral surface of the guide roller 705. In FIG. 14, with respect to the pair of front and rear first guide surfaces 101R, the pair of front and rear second guide surfaces 102R, and the pair of front and rear positioning portions 102S, the respective members on a rear side are shown.

As shown in FIG. 8, when the conveyance unit frame 40H is pulled out frontward from the body frame 100 of the apparatus body 10, an operator can mount the cleaning unit 70 on the cleaning unit mounting portion 40B of the conveyance unit frame 40H. As shown in FIG. 12, the pair of rotary levers 454 is disposed so as to extend downward from the rotary shaft 451. The pin receiving portion 454P has a shape obtained by cutting out a right side portion of the rotary lever 454 obliquely leftward and downward. Accordingly, the operator can insert and fit the pair of left and right unit fulcrum pins 70P of the cleaning unit 70 into the pin receiving portions 454P from above while holding the side wall 703A and the bottom wall 703B (FIG. 6) of the cleaning unit 70 (FIG. 13). At this stage of the operation, the above-described unit input gear 711 is disposed behind the unit fulcrum pin 70P on a front side of the cleaning unit 70. The unit fulcrum pin 70P on a rear side of the cleaning unit 70 is fitted into the pin receiving portion 454P.

When the pair of unit fulcrum pins 70P is fitted into the pin receiving portions 454P by the operator, the bottom wall 703B of the cleaning housing 70H is disposed so as to opposedly face the pair of magnets 404C, and the pair of ribs 703T is respectively brought into contact with the upper surface portion of the second right frame 404B. As a result, in addition to the pair of rotary levers 454, the cleaning unit 70 is held by the second right frame 404B by a magnetic field generated by the pair of magnets 404C. Accordingly, even when the operator leaves his hand from the cleaning unit 70, it is possible to prevent the cleaning unit 70 from being removed from the conveyance unit frame 40H.

As described above, when the cleaning unit 70 is mounted on the cleaning unit mounting portion 40B (mounting and removing position) of the conveyance unit frame 40H, the operator inserts the conveyance unit frame 40H into the body frame 100. As a result, the cleaning unit 70 is inserted into the body frame 100, and the rotation input gear 40G of the conveyance unit frame 40H engages with the unit drive output gear 805 of the unit driving unit 80 in the body frame 100. At this stage of the operation, the pair of front and rear guide rollers 705 of the cleaning unit 70 is disposed so as to opposedly face the first guide surfaces 101R of the pair of front and rear guide portions 100G at predetermined intervals in the left-right direction.

As shown in FIG. 14, when the cleaning unit 70 disposed at the mounting and removing position is viewed from a direction parallel to the axial direction of the resist lower roller 32, a center (P2) of the unit fulcrum pin 70P supported by the pin receiving portion 454P is disposed below a center axis (P1) of the rotary shaft 451 and on a right side (one end side in a width direction) of the center axis (P1) of the rotary shaft 451. A center of gravity (J) of the cleaning unit 70 is disposed on a right side of the unit fulcrum pin 70P. In the present embodiment, the pressing roller 72 includes the heavy pressing roller shaft 72S made of a metal material. Accordingly, the center of gravity (J) of the cleaning unit 70 is offset to a right side portion of the cleaning unit 70 so as to be positioned more on a right side than a center (P4) of the pressing roller 72. Further, a center (P3) of the magnet 404C in the left-right direction (width direction) is disposed on a right side (distal end side in a moving direction of the cleaning unit 70 in the left-right direction) of the center (P2) of the unit fulcrum pin 70P.

When the rotary shaft 451 of the cleaning unit rotating unit 45 is rotated from the state shown in FIG. 14 by a drive force of the unit driving unit 80, the pair of rotary levers 454 is rotated corresponding to the rotation of the rotary shaft 451. At this stage of the operation, a left end portion of the bottom wall 703B moves upward along with the movement of the unit fulcrum pin 70P. As a result, a distance between the left end portion of the bottom wall 703B and the magnet 404C is increased and hence, an effect of a magnetic restraining force generated by the magnet 404C becomes small whereby the bottom wall 703B of the cleaning unit 70 can be easily removed from the magnet 404C. Then, when the cleaning unit 70 is tilted rightward about the unit fulcrum pin 70P due to its own weight, the pair of guide rollers 705 is brought into contact with the first guide surfaces 101R of the pair of guide portions 100G respectively.

Thereafter, when the pair of rotary levers 454 further rotates corresponding to the rotation of the rotary shaft 451, the cleaning unit 70 moves upward and rightward while the pair of guide rollers 705 is guided by the first guide surface 101R. At this stage of operation, a rotation trajectory of the rotary lever 454 and a movement trajectory of the cleaning unit 70 guided by the first guide surface 101R are different from each other. In the present embodiment, the pair of unit fulcrum pins 70P of the cleaning unit 70 is supported by the pin receiving portion 454P of the rotary lever 454 so as to be rotatable relative to the pin receiving portion 454P. Accordingly, the orientation of the cleaning unit 70 can be changed along with the upward movement of the cleaning unit 70 and hence, the cleaning unit 70 can smoothly rise corresponding to the rotation of the rotary lever 454.

In a state shown in FIG. 15, the pair of guide rollers 705 is transferred from the first guide surfaces 101R to the second guide surfaces 102R. Then, when the pair of rotary levers 454 further rotates corresponding to the rotation of the rotary shaft 451, the pair of guide rollers 705 is brought into contact with and is fitted in the pair of positioning portions 102S. At this stage of the operation, as shown in FIG. 2, the pressing roller 72 of the cleaning part 70A of the cleaning unit 70 is brought into contact with the resist lower roller 32 from below along the straight line L which connects the center of the resist upper roller 31T and the center of the resist lower roller 32 to each other. When the cleaning unit 70 reaches the cleaning position shown in FIG. 2 in this manner, the pressing roller 72 presses the web W to the resist lower roller 32 and hence, paper dust, inks, and the like adhering to the surface of the resist lower roller 32 can be removed by cleaning. In the orientation of the cleaning unit 70 disposed at the cleaning position shown in FIG. 2, the center of gravity (the pressing roller 72) of the cleaning unit 70 is disposed just above the unit fulcrum pin 70P and hence, the orientation of the cleaning unit 70 at the cleaning position can be maintained in a stable manner.

In the present embodiment, using the mounting and removing position shown in FIG. 14 as the reference, the first detection sensor 803 detects a rotation amount of rotation of the pulse plate 802 so that an amount of rotation of the rotary lever 454, that is, the position of the cleaning unit 70 (cleaning position, separation position) is detected. When the second detection sensor 804 detects the cleaning housing 70H, it is detected that the cleaning unit 70 has reached the cleaning position.

Next, a control system of the image forming apparatus 1 and the cleaning device 7 according to the present embodiment is described with reference to a block diagram shown in FIG. 16. The image forming apparatus 1 further includes a controller 90.

The controller 90 is formed of, for example, a microcomputer in which a memory device such as a read only memory (ROM) for storing a control program and a flash memory for temporarily storing data is incorporated. The controller 90 controls an operation of the image forming apparatus 1 including the cleaning device 7 by reading out the control program. The controller 90 includes an image forming control unit 90G, a maintenance control unit 90M, and a cleaning control unit 90C.

The image forming control unit 90G mainly controls a sheet conveyance operation of the belt conveyance unit 40 and an image forming operation of the image forming unit 50, and executes image forming processing for the sheet S.

The maintenance control unit 90M executes maintenance processing for the line head 51 by controlling a purge mechanism 50P and a maintenance operation mechanism 61M when the operation of the image forming processing for the sheet S is stopped. The maintenance processing for the line head 51 includes cap processing, purge processing, and wiping processing.

The cap processing is processing for covering a cap on the line head 51. The maintenance control unit 90M executes the cap processing by mainly controlling the maintenance operation mechanism 61M. The maintenance operation mechanism 61M moves the cap unit 61B by moving the carriage 61A in the maintenance unit 61 (FIG. 1) between a retracted position where the cap unit 61B is retracted in a horizontal direction (left-right direction) with respect to the image forming unit 50 and a maintenance position vertically below the image forming unit 50. At the time of moving the cap unit 61B from the retracted position to the maintenance position, before moving the cap unit 61B, the maintenance operation mechanism 61M lowers the belt conveyance unit 40 vertically downward from the position just below the image forming unit 50. When the cap unit 61B is disposed at the maintenance position, the maintenance operation mechanism 61M lifts the cap unit 61B vertically upward. As a result, the cap unit 61B is brought into contact with an ink ejection surface of the line head 51 and hence, the cap unit 61B is covered by the cap.

The purge processing is processing for forcibly ejecting inks pressurized from the line head 51 for removing bubbles, foreign matters, thickened inks and the like in the ink ejection nozzles of the line head 51. The wiping processing is processing for wiping ink droplets adhering to the ink ejection surface of the line head 51 after the purge processing is performed.

The maintenance operation mechanism 61M moves the wipe unit 61C between a retracted position where the wipe unit 61C is retracted in a horizontal direction with respect to the image forming unit 50 and a maintenance position vertically below the image forming unit 50 by moving the carriage 61A. At the time of moving the wipe unit 61C from the retracted position to the maintenance position, a state is maintained where the cap unit 61B which is supported above the wipe unit 61C in the carriage 61A is at the retracted position. Further, at the time of moving the wipe unit 61C from the retracted position to the maintenance position, before moving the wipe unit 61C, the maintenance operation mechanism 61M lowers the belt conveyance unit 40 vertically downward from the position just below the image forming unit 50. When the wipe unit 61C is disposed at the maintenance position, the maintenance operation mechanism 61M lifts the wipe unit 61C vertically upward. Then, the maintenance control unit 90M executes the purge processing for the line head 51 by controlling the purge mechanism 50P. Further, the maintenance control unit 90M executes the wiping processing for the line head 51 by moving a blade unit of the wipe unit 61C by controlling the maintenance operation mechanism 61M.

The cleaning control unit 90C forms a part of the cleaning device 7, and controls cleaning of the resist lower roller 32 by the cleaning unit 70 using the web W. In the present embodiment, the cleaning control unit 90C controls cleaning of the resist lower roller 32 by the cleaning unit 70 based on a conveyed sheet number of both-surface image forming sheets S where image forming processing is applied to both the first surface (front surface) and the second surface (back surface) with respect to the sheets S conveyed by the resist roller unit 30. The cleaning control unit 90C controls cleaning of the resist lower roller 32 by the cleaning unit 70 at the time of stopping the image forming processing on the sheet S and when the resist lower roller 32 is in a sheet S non-conveyable state.

A sheet S on which an image is formed on the first surface in the both-surface image forming processing (both-side printing), as described previously, passes the sheet reversing unit 15 and the third conveyance path 13, and is conveyed into the resist roller unit 30 again in a state where the front surface and the back surface of the sheet S are reversed. At this stage of the operation, when the ink of the image formed on the first surface adheres to a surface of a PFA tube of the resist lower roller 32, the ink adheres to a distal end portion of the next sheet S from the resist lower roller 32, and the sheet is stained. Further, when the ink adhering to the resist lower roller 32 is transferred to the resist upper roller 31, the ink adheres to a first surface of the next sheet S so that an image defect occurs.

In view of the above, in the present embodiment, the cleaning control unit 90C disposes the cleaning unit 70 at the cleaning position during a cleaning time CLT (FIG. 17) set in advance corresponding to the execution of both-side printing, and disposes the cleaning unit 70 at the separation position at the time of performing one-side printing. That is, the cleaning control unit 90C disposes the cleaning unit 70 at the cleaning position within the cleaning time CLT, and disposes the cleaning unit 70 at the separation position during other time periods. As a result, the web roll WR having a limited length can perform cleaning of the resist lower roller 32 for a long time, and the web roll WR can be made compact and hence, a size of the cleaning device 7 can be made small.

Further, when an image is formed under a condition that the surface of the resist lower roller 32 is minimally stained such as one-side printing, the cleaning unit 70 is disposed at the separation position. Due to such an operation, a load imposed on the resist lower roller 32 generated by contacting of the cleaning part 70A with the resist lower roller 32 can be reduced, and it is possible to suppress unnecessary feeding of the web W.

Figure 20:
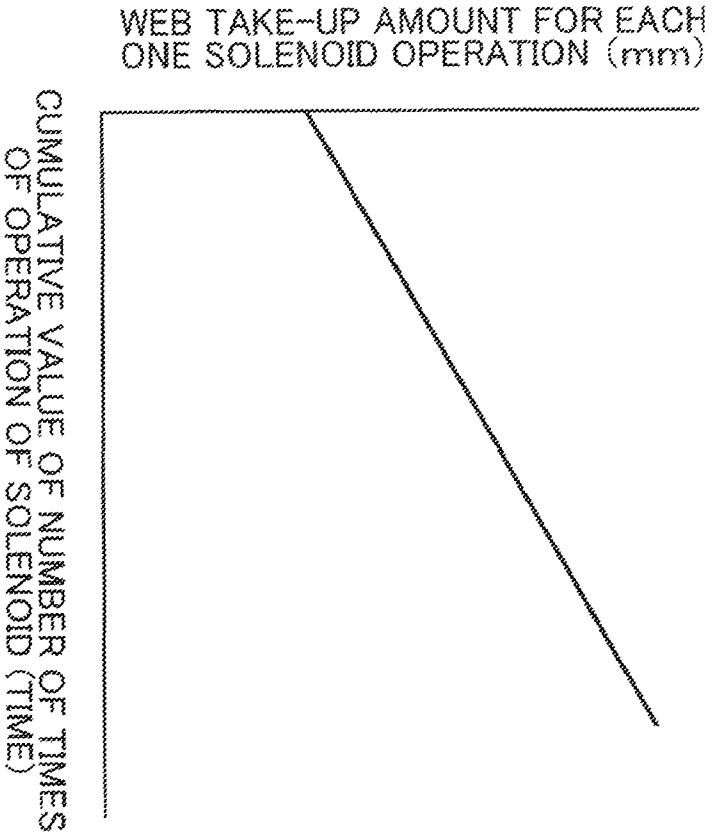
FIG. 20 is a graph showing the relationship between a cumulative value of the number of times of solenoid operations and a web take-up amount for each one solenoid operation.

A control of the cleaning control unit 90C is described with reference to FIGS. 17 to 21 in addition to FIG. 16. FIG. 17 is a timing chart at the time of cleaning the resist lower roller 32 by the web W of the cleaning unit 70. FIG. 18 is a table showing conversion rate related information J1 stored in a memory unit 99 of the cleaning control unit 90C. FIG. 19 is a table showing threshold-value related information J2 stored in the memory unit 99. FIG. 20 is a graph showing the relationship between a cumulative value of the number of times of operation of the solenoid 811 and a web take-up amount for each operation of the solenoid 811. FIG. 21 is a table showing operation number setting information J3 stored in the memory unit 99.

Figure 16:
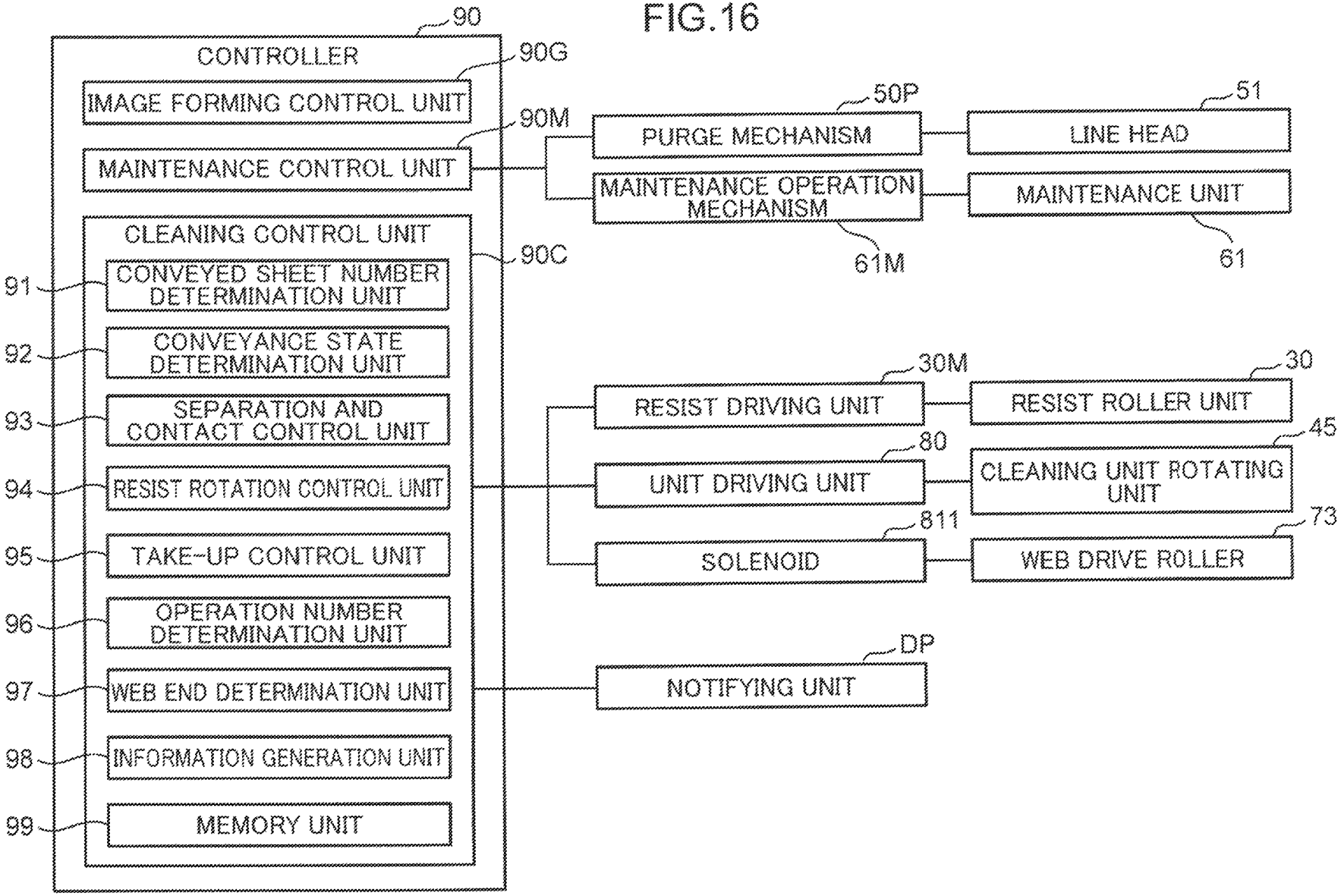
FIG. 16 is a block diagram showing the electrical configuration of the image forming apparatus.
Figure 17:
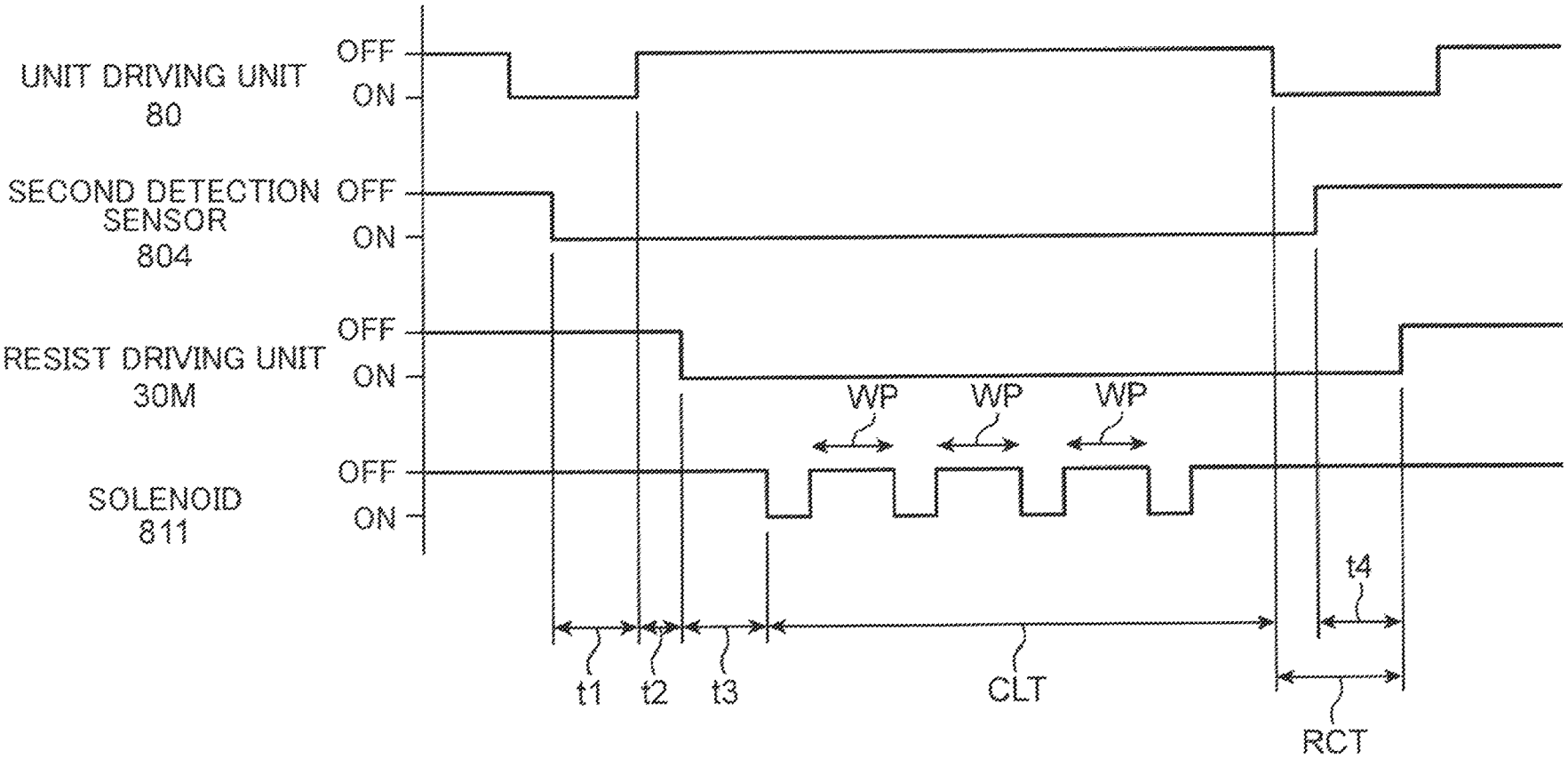
FIG. 17 is a timing chart when a resist lower roller is cleaned by a web of the cleaning unit.

As shown in FIG. 16, the cleaning control unit 90C includes a conveyed sheet number determination unit 91, a conveyance state determination unit 92, a separation and contact control unit 93, a resist rotation control unit 94, and a take-up control unit 95, an operation number determination unit 96, a web end determination unit 97, an information generation unit 98, and the memory unit 99.

The memory unit 99 stores information which is referred at the time of controlling cleaning of the resist lower roller 32 by the web W of the cleaning unit 70. The memory unit 99 stores the conversion rate related information J1 shown in FIG. 18, the threshold-value related information J2 shown in FIG. 19, and the operation number setting information J3 shown in FIG. 21 respectively.

The conversion rate related information J1 shown in FIG. 18 is information indicating a conversion rate for converting a size of the sheet S into the conveyed sheet number of the sheets S for each size of the sheet S, and is information where sheet size information J11 and conversion rate information J12 are associated with each other.

The sheet size information J11 is information indicating a size of the sheet S. A size of the sheet S is represented by, for example, "A4 size" or "A3 size". The conversion rate information J12 is information indicating a conversion rate related to the conveyed sheet number of the sheets S conveyed by the resist roller unit 30. The conversion rate registered in the conversion rate information J12 is set to have a larger value as the size of the sheet S registered in the sheet size information J11 is increased. For example, with respect to sizes "SS1" and "SS2" of the sheet S registered in the sheet size information J11, assume a case where, "SS1" indicates "A4 size" and "SS2" indicates "A3 size". In this case, with respect to the conversion rates "CR1" and "CR2" registered in the conversion rate information J12, "CR2" associated with "SS2" indicates a larger value than "CR1" associated with "SS1". For example, when the conversion rate "CR1" is "1", the conversion rate "CR2" is "2". In this case, when one "A4 size" sheet S is conveyed by the resist roller unit 30, the conveyed sheet number of the sheet S is corrected as "1". On the other hand, when one "A3 size" sheet S is conveyed by the resist roller unit 30, the conveyed sheet number of the sheets S is corrected as "2". The conversion rate related information J1 is referred by the conveyed sheet number determination unit 91 described later.

The threshold-value related information J2 shown in FIG. 19 is information indicating a conveyance determination threshold value which is referred when the conveyed sheet number determination unit 91 determines the conveyed sheet number of the sheets S conveyed by the resist roller unit 30. In the threshold-value related information J2, timing condition information J21, printing condition information J22, and conveyance determination threshold value information J23 are associated with each other.

The timing condition information J21 is information indicating a condition of a timing at which the cleaning unit 70 is moved from the separation position to the cleaning position by a drive force of the unit driving unit 80. As described above, the cleaning control unit 90C controls cleaning of the resist lower roller 32 by the cleaning unit 70 at the time of stopping the image forming processing on the sheet S and when the resist lower roller 32 is in a sheet S non-conveyable state. Accordingly, movement timing of the cleaning unit 70 registered in the timing condition information J21 is formed of first timing and second timing at which the condition that the resist lower roller 32 is in a sheet S non-conveyable state is satisfied. The first timing is set within a period from a point of time that a series of image forming processing on a continuous sheet S is finished to a point of time that next image forming processing is started. The second timing is set within a period during which maintenance processing on the line head 51 is executed by the maintenance control unit 90M at the time of stopping image forming processing on the sheet S. In the example shown in FIG. 19, in the timing condition information J21, information indicating the first timing is registered as "CT1", and information indicating the second timing is registered as "CT2".

The printing condition information J22 is information indicating a printing condition of an image on the sheet S. The printing condition information J22 is, for example, information indicating a printing ratio. The printing condition information J22 is registered for each movement timing of the cleaning unit 70 indicated in the timing condition information J21. In the example shown in FIG. 19, "CP1", "CP2" and the like are registered as the printing condition information J22 corresponding to respective "CT1" and "CT2" of the timing condition information J21.

The conveyance determination threshold value information J23 is information indicating a conveyance determination threshold value which the conveyed sheet number determination unit 91 refers when the conveyed sheet number determination unit 91 determines the conveyed number of the sheets S conveyed by the resist roller unit 30. In the example shown in FIG. 19, "TT11" and "TT12" are registered as the conveyance determination threshold value information J23 for respective "CP1" and "CP2" of the printing condition information J22 corresponding to "CT1" of the timing condition information J21. Further, "TT21" and "TT22" are registered as the conveyance determination threshold value information J23 for respective "CP1" and "CP2" of the printing condition information J22 corresponding to "CT2" of the timing condition information J21.

A different value is set as the conveyance determination threshold value registered in the conveyance determination threshold value information J23 corresponding to the movement timing of the cleaning unit 70 registered in the timing condition information J21. For example, the conveyance determination threshold values "TT11" and "TT21" registered in the conveyance determination threshold value information J23 are compared with each other. In this case, the conveyance determination threshold value "TT1" associated with "CT1" which indicates the first timing in the timing condition information J21 is set to a value smaller than the conveyance determination threshold value "TT21" associated with "CT2" which indicates the second timing in the timing condition information J21. Further, the conveyance determination threshold value registered in the conveyance determination threshold value information J23 is set to a smaller value as the printing ratio registered in the printing condition information J22 is increased.

The operation number setting information J3 shown in FIG. 21 is information indicating a solenoid operation number setting value which is referred when the take-up control unit 95 described later sets the number of times of take-up operation of the web W by the web drive roller 73. The number of times of take-up operation of the web W by the web drive roller 73 is equal to the number of times of operation of the solenoid 811. In the operation number setting information J3, cumulative value information J31 and operation number setting value information J32 are associated with each other.

The cumulative value information J31 is information which indicates a cumulative value of the number of times of the take-up operation of the web W by the web drive roller 73, that is, a cumulative value of the number of times of operation of the solenoid 811. The operation number setting value information J32 is information which indicates a set value of the number of times of take-up operation of the web W by the web drive roller 73 within the cleaning time CLT (FIG. 17) set in advance, that is, a set value of the number of times of the operation of the solenoid 811 in one cleaning. The solenoid operation number setting value registered in the operation number setting value information J32 is set to a smaller value as a cumulative value of the number of times of operation of the solenoid 811 registered in the cumulative value information J31 is increased.

The conveyed sheet number determination unit 91 monitors a conveyed sheet number of both-surface image forming sheets S with respect to the sheets S conveyed by the resist roller unit 30 in a state where the cleaning unit 70 is disposed at the separation position. Then, the conveyed sheet number determination unit 91 refers the threshold-value related information J2 stored in the memory unit 99, and determines whether or not a cumulative value of the conveyed sheet number of both-surface image forming sheets S has reached the conveyance determination threshold value indicated in the conveyance determination threshold value information J23. At this stage of the operation, the conveyed sheet number determination unit 91 refers the conversion rate related information J1 stored in the memory unit 99, and corrects the conveyed sheet number based on a conversion rate indicated in the conversion rate information J12 corresponding to a size of a both-surface image forming sheet S. Then, the conveyed sheet number determination unit 91 determines whether or not a cumulative value of the corrected conveyed sheet number has reached the conveyance determination threshold value.

The conveyance state determination unit 92 determines whether or not a condition that defines the first timing and the second timing indicated in the timing condition information J21 of the threshold-value related information J2 stored in the memory unit 99 is satisfied. With such processing, the conveyance state determination unit 92 determines whether the resist lower roller 32 of the resist roller unit 30 is in either a sheet S conveyable state or a sheet S non-conveyable state. The conveyance state determination unit 92 determines that the resist lower roller 32 is in a sheet S non-conveyable state during a period from a point of time that a series of image forming processing on a continuous sheet S is finished to a point of time that next image forming processing is started which is a condition that defines the first timing. Further, the conveyance state determination unit 92 determines that the resist lower roller 32 is in a sheet S non-conveyable state during a period where maintenance processing for the line head 51 is executed by the maintenance control unit 90M which is a condition that defines the second timing.

The separation and contact control unit 93 controls the unit driving unit 80 so as to move the cleaning unit 70. Assume a case where it is determined that a cumulative value of the conveyed sheet number of both-surface image forming sheets S has reached the conveyance determination threshold value by the conveyed sheet number determination unit 91, and it is determined that the resist lower roller 32 is in a non-conveyable state by the conveyance state determination unit 92. In this case, the separation and contact control unit 93 controls the unit driving unit 80 to move the cleaning unit 70 from the separation position to the cleaning position so as to allow the web W to be pressed to the resist lower roller 32 by the pressing roller 72. When the cleaning unit 70 is disposed at the cleaning position by driving the unit driving unit 80, the second detection sensor 804 detects the cleaning unit 70. When a predetermined first time t1 is elapsed from a point of time that the cleaning unit 70 is detected by the second detection sensor 804, the separation and contact control unit 93 stops driving of the unit driving unit 80 (see FIG. 17). The first time t1 is set to 400 ms, for example.

The resist rotation control unit 94 controls the resist driving unit 30M in a state where the web W is pressed to the resist lower roller 32 in the cleaning unit 70 disposed at the cleaning position, and rotates the resist upper roller 31 and the resist lower roller 32. The resist rotation control unit 94 drives the resist driving unit 30M after a predetermined second time t2 is elapsed from a point of time that driving of the unit driving unit 80 is stopped (see FIG. 17). The second time t2 is set to 100 ms, for example. By rotating the resist lower roller 32 in a state where the web W is pressed to the resist lower roller 32, the surface of the resist lower roller 32 can be cleaned by the web W.

In the present embodiment, the resist rotation control unit 94 controls the resist driving unit 30M, and rotates the resist lower roller 32 at a cleaning rotation speed lower than a conveying-time rotation speed of the resist lower roller 32 in a sheet S conveyable state. Although the details are described later, a take-up operation of the web W by the web drive roller 73 based on an operation of the solenoid 811 is performed plural times at a predetermined time interval within the predetermined cleaning time CLT (see FIG. 17). The resist rotation control unit 94 sets the cleaning rotation speed within a range of from a speed equal to or higher than a first rotation speed at which one rotation of the resist lower roller 32 is enabled during a take-up standby period WP between each of the plurality of take-up operations to a speed equal to or lower than a second rotation speed which is a half of the conveying-time rotation speed. By setting a rotation speed of the resist lower roller 32 in a state where the web W is pressed to the resist lower roller 32 to a cleaning rotation speed lower than the conveying-time rotation speed, a contact time of the resist lower roller 32 with the web W can be increased. Accordingly, cleaning of the resist lower roller 32 by the web W can be performed more effectively.

The take-up control unit 95 performs a control of switching a state of supplying electricity to the solenoid 811 between an electricity supply state and an electricity supply stop state in a state where the resist lower roller 32 is being rotated. By controlling switching of the state of supplying electricity to the solenoid 811 as described above, the take-up control unit 95 allows the web drive roller 73 to perform the take-up operation of the web W plural times at a predetermined time interval within the predetermined cleaning time CLT. The take-up control unit 95 controls the switching of the state of supplying electricity to the solenoid 811 after a predetermined third time t3 is elapsed from a point of time that driving of the resist driving unit 30M is started (see FIG. 17). The third time t3 is set to 1000 ms, for example. Further, the cleaning time CLT is set to a value within a range of from 10 seconds to 30 seconds, for example, based on a printing ratio or the like of an image formed on the sheet S during a period in which the image forming unit 50 executes the image forming processing.

In a state where the cleaning unit 70 is disposed at the cleaning position, a web pressing nip portion is formed due to pressing of the pressing roller 72 to the resist lower roller 32. A nip width of the web pressing nip portion is set to a value which falls within a range of from 2.5 mm to 5.0 mm, for example. The take-up control unit 95 sets a total take-up amount of the web W taken up by the web drive roller 73 due to a plurality of take-up operations within the cleaning time CLT such that the total take-up amount agrees with the nip width of the web pressing nip portion.

In cleaning the resist lower roller 32 by the web W, the take-up control unit 95 allows the web drive roller 73 to perform the take-up operation of the web W corresponding to the rotation of the web drive roller 73 plural times at a predetermined time interval within the cleaning time CLT. Accordingly, a portion of the web W which is brought into contact with the resist lower roller 32 can be changed plural times within one cleaning time CLT. Accordingly, even in a case where an ink or the like for forming an image on the sheet S adheres to the resist lower roller 32, the ink or the like can be removed from the resist lower roller 32 with certainty and can be collected on the web W, and thus cleaning the resist lower roller 32 properly.

When the take-up operation of the web W by the web drive roller 73 is performed by the operation of the solenoid 811, a rolled body formed of the web W is formed on the web drive roller 73. An outer diameter of the rolled body formed of the web W formed on the web drive roller 73 is increased each time the web drive roller 73 performs the take-up operation corresponding to the operation of the solenoid 811. That is, the outer diameter of the rolled body formed of the web W formed on the web drive roller 73 is increased as a cumulative value of the number of times of operation of the solenoid 811 corresponding to the number of times of the take-up operation of the web drive roller 73 is increased. When the outer diameter of the rolled body formed of the web W formed on the web drive roller 73 is increased, a take-up amount of the web W taken up by the web drive roller 73 by one operation of the solenoid 811 is increased (see FIG. 20). Accordingly, in a case where the number of times of take-up operation of the web drive roller 73, that is, the number of times of operation of the solenoid 811 within the cleaning time CLT is set to be constant, the take-up amount of the web W corresponding to the rotation of the web drive roller 73 changes corresponding to a cumulative value of the number of times of operation of the solenoid 811.

In view of the above, the take-up control unit 95 is configured to be capable of executing monitoring processing, operation number setting processing, and take-up processing. In the monitoring processing, the take-up control unit 95 monitors a cumulative value of the number of times of operation of the solenoid 811 and thus monitoring the number of times of take-up operation of the web W by the web drive roller 73. Further, in the operation number setting processing, the take-up control unit 95 sets the number of times of take-up operation of the web W by the web drive roller 73, that is, the number of times of operation of the solenoid 811 in one cleaning within the cleaning time CLT. The take-up control unit 95 refers the operation number setting information J3 stored in the memory unit 99, and sets the number of times of operation of the solenoid 811 in one cleaning corresponding to a cumulative value of the number of times of operation of the solenoid 811 such that a total take-up amount of the web W taken-up by the web drive roller 73 due to the take-up operation performed plural times within the cleaning time CLT becomes constant within a predetermined allowable range. Then, in the take-up processing, the take-up control unit 95 allows the solenoids 811 to perform an operation the number of times corresponding to the number of times set in the operation number setting processing at a predetermined time interval within the cleaning time CLT.

In the take-up processing, the take-up control unit 95 allows the web drive roller 73 to perform the respective plural-time take-up operations of the web W based on the operation of the solenoid 811 at equal time intervals. Accordingly, a portion of the web W which is brought into contact with the resist lower roller 32 can be changed plural times at equal time intervals within one cleaning time CLT.

When cleaning of the resist lower roller 32 by the web W within the cleaning time CLT is finished, the resist rotation control unit 94 controls the resist driving unit 30M such that the rotation of the resist lower roller 32 continues within a predetermined rotation continuation time RCT from a point of time of the end of the cleaning time CLT (see FIG. 17). Then, the separation and contact control unit 93 controls the unit driving unit 80, and moves the cleaning unit 70 from the cleaning position to the separation position such that the web W is separated from the resist lower roller 32 within the rotation continuation time RCT.

When the cleaning unit 70 is moved from the cleaning position to the separation position by driving the unit driving unit 80, the detection of the cleaning unit 70 by the second detection sensor 804 is released. When a predetermined fourth time t4 is elapsed from a point of time that the detection of the cleaning unit 70 by the second detection sensor 804 is released, the resist rotation control unit 94 stops driving of the resist driving unit 30M (see FIG. 17). The fourth time t4 is set to 500 ms, for example. Note that when the cleaning unit is disposed at the separation position, the separation and contact control unit 93 stops driving of the unit driving unit 80.

As described above, after cleaning the resist lower roller 32 by the web W, the web W is separated from the resist lower roller 32 in a state where the rotation of the resist lower roller 32 is continued. Accordingly, paper dust, ink, and the like adhering to the resist lower roller 32 can be removed from the resist lower roller 32 with more certainty and can be collected on the web W.

The operation number determination unit 96 monitors the number of times of operation of the solenoid 811 in response to the supplying of electricity, and determines whether or not a cumulative value of the number of times of operation of the solenoid 811 has reached a predetermined operation determination threshold value. The operation determination threshold value is set to a value which enables a recognition of a fact that a remaining amount of the web roll WR supported by the web driven roller 71 has reached a predetermined warning remaining amount due to a take-up operation of the web W by the web drive roller 73 based on an operation of the solenoid 811. For example, assume a case where a total length of the web roll WR is "5 m" and an average value of take-up amount of the web W by the web drive roller 73 based on one operation of the solenoid 811 is "3.75 mm". In this case, theoretically, an end of the web W is exposed on a peripheral surface of the web driven roller 71 when a cumulative value of the number of times of operation of the solenoid 811 reaches "1333". However, in an actual practice, as shown in FIG. 20, as a cumulative value of the number of times of operation of the solenoid 811 is increased, a take-up amount of the web W taken up by the web drive roller 73 by one operation of the solenoid 811 is increased so that a take-up amount of the web W is changed. In view of the above, a cumulative value "1300" which is smaller within a predetermined range than a cumulative value "1333" which is the number of times of operation of the solenoid 811 at which it is theoretically estimated that the end of the web W is exposed on the web driven roller 71 is set as the operation determination threshold value.

In a case where a cumulative value of the number of times of operation of the solenoid 811 has reached the operation determination threshold value, the web end determination unit 97 executes web end determination processing for determining whether or not the end of the web W is exposed on the web driven roller 71. The web end determination unit 97 determines whether or not the end of the web W is exposed on the web driven roller 71 based on the state of supplying electricity to the solenoid 811 and the detection result of the third detection sensor 813. In a case where the detection result of the third detection sensor 813 is not changed in spite of a fact that supplying of electricity to the solenoid 811 is performed, the web end determination unit 97 determines that the end of the web W is exposed on the web driven roller 71. Accordingly, it is possible to precisely determine a fact that the end of the web W is exposed on a peripheral surface of the web driven roller 71 so that it is necessary to exchange the web W, that is, it is necessary to exchange the cleaning unit 70. Accordingly, in exchanging the cleaning unit 70, the web W can be entirely used up without wasting the web W with respect to the web roll WR supported by the web driven roller 71.

The information generation unit 98 generates information indicating respective determination results of the operation number determination unit 96 and the web end determination unit 97. Assume a case where the operation number determination unit 96 determines that a cumulative value of the number of times of operation of the solenoid 811 has reached the operation determination threshold value. In this case, the information generation unit 98 generates web remaining amount warning information for notifying that a remaining amount of the web roll WR supported by the web driven roller 71 has reached a predetermined warning remaining amount. The web remaining amount warning information is, for example, message information such as "A remaining amount of the web roll WR becomes small". On the other hand, assume a case where the web end determination unit 97 determines that an end of the web W is exposed on the web driven roller 71. In this case, the information generation unit 98 generates web exchange request information for notifying that it is necessary to exchange the web W, that is, it is necessary to exchange the cleaning unit 70. The web exchange request information is message information such as "Web roll WR is entirely fed out. Please exchange the cleaning unit 70" or the like, for example.

The web remaining amount warning information and the web exchange request information generated by the information generation unit 98 are outputted to a notifying unit DP (FIG. 16) which the image forming apparatus 1 includes. The notifying unit DP notifies the web remaining amount warning information and the web exchange request information outputted from the information generation unit 98. The operator can grasp the fact that the remaining amount of the web roll WR has become small by recognizing the web remaining amount warning information which is notified by the notifying unit DP. Further, the operator can grasp the fact that it is necessary to exchange the cleaning unit 70 by recognizing the web exchange request information notified by the notifying unit DP.

When the operator who recognizes the web exchange request information instructs execution of the exchange operation of the cleaning unit 70 at an operation unit (not shown) of the image forming apparatus 1, the separation and contact control unit 93 moves the cleaning unit 70 to the mounting and removing position by controlling the unit driving unit 80. Then, the operator pulls out the conveyance unit frame 40H forward from the body frame 100 of the apparatus body 10, and takes out the cleaning unit 70 from the cleaning unit mounting portion 40B of the conveyance unit frame 40H. Subsequently, the operator mounts the new cleaning unit 70 on the cleaning unit mounting portion 40B of the conveyance unit frame 40H.

In the present embodiment, when the cleaning unit 70 is removed from the apparatus body 10 integrally with the conveyance unit frame 40H, a part of the drive transmission system between the rotation drive unit 75K and the pair of rotary levers 454 (the engagement between an apparatus body 10G and the unit drive output gear 805) is disconnected. As a result, the pair of rotary levers 454 becomes rotatable about the rotary shaft 451. Accordingly, when the operator removes the old cleaning unit 70 from the cleaning unit mounting portion 40B, the pair of rotary levers 454 can rotate so as to send out the cleaning unit 70 to the outside of the cleaning unit mounting portion 40B. In other words, the pair of rotary levers 454 rotates about the rotary shaft 451 so as to assist the removal of the pair of unit fulcrum pins 70P of the cleaning unit 70 from the pair of pin receiving portions 454P. As a result, the operator can easily remove the pair of unit fulcrum pins 70P of the cleaning unit 70 from the pair of pin receiving portions 454P. Accordingly, the cleaning unit 70 can be easily removed from the conveyance unit frame 40H of the belt conveyance unit 40.

The cleaning device 7 and the image forming apparatus 1 including the cleaning device 7 according to one embodiment of the present disclosure have been described above. With such a configuration, paper dust, ink, and the like can be removed from the resist lower roller 32 with certainty, and can be collected on the web W. Accordingly, the resist lower roller 32 can be properly cleaned. Accordingly, it is possible to suppress the occurrence of conveyance failure of the sheet S and the occurrence of stains such as ink on the sheet S and hence, the image forming apparatus 1 can form a proper image.

The present disclosure is not limited to the above embodiment, and the following modified embodiments can be adopted.

In the above-described embodiment, the description has been made with respect to the mode where the web W is separated from and brought into contact with the resist lower roller 32 by changing the position of the pressing roller 72 with respect to the resist lower roller 32 along with the movement of the cleaning unit 70. However, the present disclosure is not limited to such a mode. For example, the configuration may be adopted where the pressing roller 72 is disposed in a vertically movable manner, and the web W is separated from and is brought into contact with the resist lower roller 32 by moving the pressing roller 72.

In the above-described embodiment, the description has been made using the resist lower roller 32 as the conveyance roller to be cleaned by the cleaning unit 70. However, the conveyance roller may be another roller which conveys the sheet S.

Further, in the above-described embodiment, the description has been made with respect to the mode where the image forming unit 50 is formed of an ink-jet-type image forming unit. However, the image forming unit 50 may be formed of an image forming unit which adopts another image forming method such as a publicly known electrophotographic method.

According to the present disclosure described above, it is possible to provide a cleaning device capable of precisely determine timing of exchanging a web used for cleaning a conveyance roller which conveys a sheet, and an image forming apparatus provided with the cleaning device.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device capable of cleaning a surface of a conveyance roller that is rotatably supported on an apparatus body of an image forming apparatus and is configured to convey a sheet, the cleaning device comprising:

a strip-shaped web configured to clean the surface of the conveyance roller by being brought into contact with the surface of the conveyance roller;

a support roller configured to support a rolled body formed of the web;

a take-up roller configured to be rotatably driven and configured to take up the web while pulling out the web from the support roller;

a pressing roller configured to be brought into contact with the web between the support roller and the take-up roller, and configured to press the web to the conveyance roller;

a solenoid configured to be operated with supplying of electricity to the solenoid and configured to rotatably drive the take-up roller;

a displacement member configured to be displaced by an operation of the solenoid and having a detection piece fixedly mounted on the displacement member;

a detection unit configured to detect the detection piece when the detection piece is disposed in a predetermined detection region corresponding to a displacement of the displacement member; and a controller configured to control cleaning of the conveyance roller by the web, wherein the controller includes:

a take-up control unit configured to control an operation of the solenoid such that a take-up operation where the web is taken up by rotatably driving the take-up roller is performed in a state where the web is pressed to the conveyance roller by the pressing roller; and a web end determination unit configured to determine whether or not an end of the web is exposed on the support roller by the take-up operation of the take-up roller based on a state of supplying electricity to the solenoid and a detection result of the detection unit, and the web end determination unit is configured to determine that the end of the web is exposed on the support roller when the detection result of the detection unit is not changed in spite of a fact that supplying of electricity to the solenoid is performed.

2. The cleaning device according to claim 1, wherein the take-up roller includes a drive input portion to which a rotational drive force is inputted, the displacement member is formed of a rotary member on which a detection piece is fixedly mounted and which is rotatably mounted on the apparatus body, and the solenoid is configured to rotate the rotary member with supplying of electricity to the solenoid, and configured to output a rotational force of the rotary member as the rotational drive force to the drive input portion.

3. The cleaning device according to claim 1, wherein the controller further includes an operation number determination unit configured to monitor a number of times of operation corresponding to supplying of electricity to the solenoid, and configured to determine whether or not a cumulative value of the number of times of operation has reached a predetermined threshold value, and the web end determination unit is configured to perform web end determination processing for determining whether or not the end of the web is exposed on the support roller when the cumulative value of the number of times of operation has reached the threshold value.

4. The cleaning device according to claim 3, wherein the controller further includes an information generation unit configured to generate information indicating respective determination results of the web end determination unit and the operation number determination unit, the information generation unit configured to generate web exchange request information for notifying a fact that an exchange of the web is necessary when the web end determination unit determines that the end of the web is exposed on the support roller, and the information generation unit configured to generate web remaining amount warning information for notifying a fact that a remaining amount of a rolled body formed of the web supported on the support roller has reached a predetermined warning remaining amount when the operation number determination unit determines that a cumulative value of the number of times of operation has reached the threshold value.

5. An image forming apparatus comprising:

an apparatus body;

a conveyance roller configured to be rotatably supported on the apparatus body and to convey a sheet;

an image forming unit configured to form an image on the sheet; and the cleaning device according to claim 1 configured to clean the conveyance roller.

* * * * *